US007611232B2

(12) United States Patent
Koike et al.

(10) Patent No.: US 7,611,232 B2
(45) **Date of Patent: *Nov. 3, 2009**

(54) MULTI-NOZZLE INK JET HEAD

(75) Inventors: Shuji Koike, Setagaya (JP); Yoshiaki Sakamoto, Kawasaki (JP); Tomohisa Shingai, Kawasaki (JP)

(73) Assignee: Fuji Photo Film Co., Ltd., Minami-Ashigara-shi (JP)

( * ) Notice: Subject to any disclaimer, the term of this patent is extended or adjusted under 35 U.S.C. 154(b) by 204 days.

This patent is subject to a terminal disclaimer.

(21) Appl. No.: 11/642,739

(22) Filed: Dec. 21, 2006

(65) Prior Publication Data

US 2007/0103518 A1 May 10, 2007

Related U.S. Application Data

(60) Division of application No. 11/097,138, filed on Apr. 4, 2005, now Pat. No. 7,168,793, which is a division of application No. 10/807,175, filed on Mar. 24, 2004, now Pat. No. 6,902,263, which is a division of application No. 10/254,782, filed on Sep. 26, 2002, now abandoned, which is a continuation of application No. PCT/JP00/02137, filed on Mar. 31, 2000.

(51) Int. Cl.
*B41J 2/45* (2006.01)

(52) U.S. Cl. ..... 347/71

(58) Field of Classification Search ..... 347/68–72, 347/10, 50

See application file for complete search history.

(56) References Cited

U.S. PATENT DOCUMENTS

| | | | | |
|---|---|---|---|---|
| 6,231,151 | B1 | 5/2001 | Hotomi et al. | 347/11 |
| 6,336,717 | B1 * | 1/2002 | Shimada et al. | 347/71 |
| 6,902,263 | B2 * | 6/2005 | Koike et al. | 347/71 |

FOREIGN PATENT DOCUMENTS

| | | | |
|---|---|---|---|
| EP | 0782923 | A1 | 7/1997 |
| JP | 05 167387 | A | 8/1993 |
| JP | 7-81070 | | 3/1995 |
| JP | 8-118626 | | 5/1996 |
| JP | 10-202876 | | 8/1998 |
| JP | 11-227196 | | 8/1999 |
| JP | 11-227196 | A | 8/1999 |
| JP | 11227196 | A * | 8/1999 |
| JP | 11-314365 | | 11/1999 |

* cited by examiner

*Primary Examiner*—Hai C Pham
(74) *Attorney, Agent, or Firm*—Kratz, Quintos & Hanson, LLP

(57) ABSTRACT

A multi-nozzle ink jet head having a diaphragm that effectively utilizes the force generated by thin-film piezoelectric elements is disclosed. The head (2) has a head substrate (28) in which are formed a plurality of nozzles (39) and a plurality of pressure chambers (29), a multi-layer diaphragm (23-1, 23-2), piezoelectric elements (27), and individual electrodes (26). By making the thickness of the common electrode layer (23-1) of the multi-layer diaphragm be thin but such that problems do not occur during multi-pin driving, optimization of the rigid layer becomes possible, and hence it is possible to use the force generated by the thin-film piezoelectric elements efficiently in ink ejection.

2 Claims, 24 Drawing Sheets

Pc1=Pc2=Pc3=Pc4=Pc5
rG1=rG2=rG3=rG4=rG5

FIG. 5

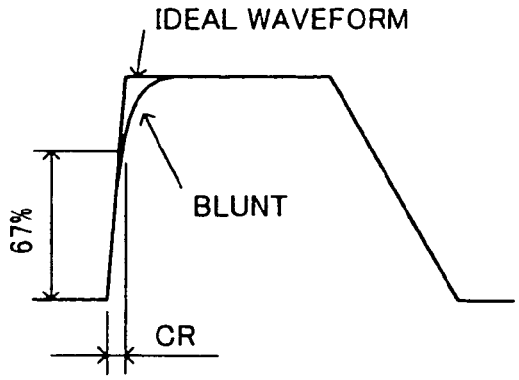

FIG. 6

| | |
|---|---|
| PRESSURE CHAMBER LENGTH Lc(m) | 7.00E-04 |
| SIGNAL LINE LENGTH Lsig | 1.00E-04 |
| PIEZO THICKNESS tp(m) | 1.00E-06 |
| PIEZO WIDTH wp(m) | 7.00E-05 |

| | |
|---|---|
| VACUUM PERMITTIVITY $\varepsilon 0$ | 8.85E-12 |
| PIEZO SPECIFIC PERMITTIVITY $\varepsilon / \varepsilon 0$ | 420 |

| | |
|---|---|
| PIEZO CAPACITANCE Cp(pF) | 208.152 |
| Cp= $\varepsilon$ *(Lv+Lsig)*wp/tp | |

| | |
|---|---|
| RESISTANCE CR : $\rho$ ($\Omega$ ·m) | 1.27E-07 |

| | | | |
|---|---|---|---|
| NOZZLE PITCH (m) | 1.70E-04 | | |
| THE NUMBER OF NOZZLES | 64 | | |
| COMMON ELECTRODE LENGTH (m) | 5.44E-03 | ←DISTANCE FROM BOTH ENDS OF 64 PIN ARRANGEMENT | |
| APPLIED VOLTAGE (V) | 20 | SINGLE PIN DRIVE (pF) | 208.152 |
| WAVEFORM RISE TIME (ns) | 50 | ALL PIN DRIVE (pF) | 13321.7 |

FIG. 7

| CrTHICKNESS | 0.1 | 0.2 | 0.3 | 0.4 | 0.5 | 0.6 |
|---|---|---|---|---|---|---|
| RESISTANCE | 11.5147 | 5.75733 | 3.83822 | 2.87867 | 2.30293 | 1.91911 |
| 1-CR | 2.4E-09 | 1.2E-09 | 8E-10 | 6E-10 | 4.8E-10 | 4E-10 |
| all-CR | 1.5E-07 | 7.7E-08 | 5.1E-08 | 3.8E-08 | 3.1E-08 | 2.6E-08 |

1-CR : WAVEFORM RISE TIME WHEN SINGLE PIN DRIVE
all-CR : WAVEFORM RISE TIME WHEN ALL PIN DRIVE

| RESISTANCE Ni : ρ(Ω·m) | 7.24E-08 |
|---|---|

| NiTHICKNESS | 0.1 | 0.15 | 0.2 | 0.25 | 0.3 | 0.35 |
|---|---|---|---|---|---|---|
| RESISTANCE | 6.56427 | 4.37618 | 3.28213 | 2.26571 | 2.18809 | 1.8755 |
| 1-CR | 1.4E-09 | 9.1E-10 | 6.8E-10 | 5.5E-10 | 4.6E-10 | 3.9E-10 |
| all-CR | 8.7E-08 | 5.83E-08 | 4.37E-08 | 3.5E-08 | 2.9E-08 | 2.5E-08 |

1-CR : WAVEFORM RISE TIME WHEN SINGLE PIN DRIVE
all-CR : WAVEFORM RISE TIME WHEN ALL PIN DRIVE

| | | | |
|---|---|---|---|
| NOZZLE PITCH (m) | 1.70E-04 | | |
| THE NUMBER OF NOZZLES | 21 | ←THREE POINTS ARE EARTHED AT 64 PIN | |
| COMMON ELECTRODE LENGTH (m) | 1.96E-03 | ←DISTANCE FROM BLOCK CONTACNT | |
| APPLIED VOLTAGE (V) | 20 | SINGLE PIN DRIVE (pF) | 208.152 |
| WAVEFORM RISE TIME (ns) | 50 | ALL PIN DRIVE (pF) | 4440.58 |

| CrTHICKNESS | 0.1 | 0.12 | 0.14 | 0.16 | 0.18 | 0.2 |
|---|---|---|---|---|---|---|
| RESISTANCE | 14.6596 | 12.2164 | 10.4712 | 9.16228 | 8.14425 | 7.32982 |
| 1-CR | 3.05E-09 | 2.54E-09 | 2.18E-09 | 1.91E-09 | 1.70E-09 | 1.53E-09 |
| all-CR | 6.51E-08 | 5.42E-08 | 4.65E-08 | 4.07E-08 | 3.62E-08 | 3.25E-08 |

1-CR : WAVEFORM RISE TIME WHEN SINGLE PIN DRIVE
all-CR : WAVEFORM RISE TIME WHEN ALL PIN DRIVE

| | |
|---|---|
| RESISTANCE Ni : ρ (Ω·m) | 7.24E-08 |

| | | | |
|---|---|---|---|
| NOZZLE PITCH (m) | 1.70E-04 | | |
| THE NUMBER OF NOZZLES | 21 | ←THREE POINTS ARE EARTHED AT 64 PIN | |
| COMMON ELECTRODE LENGTH (m) | 1.94E-03 | ←DISTANCE FROM BLOCK CONTANCT | |
| APPLIED VOLTAGE (V) | 20 | SINGLE PIN DRIVE (pF) | 208.152 |
| WAVEFORM RISE TIME (ns) | 50 | ALL PIN DRIVE (pF) | 4371.19 |

| NiTHICKNESS | 0.02 | 0.04 | 0.06 | 0.08 | 0.1 | 0.12 |
|---|---|---|---|---|---|---|
| RESISTANCE | 41.2289 | 20.6144 | 13.743 | 10.3072 | 8.24577 | 6.87148 |
| 1-CR | 8.58E-09 | 4.29E-09 | 2.86E-09 | 2.15E-09 | 1.72E-09 | 1.43E-09 |
| all-CR | 1.80E-07 | 9.01E-08 | 6.01E-08 | 4.51E-08 | 3.60E-08 | 3.00E-08 |

1-CR : WAVEFORM RISE TIME WHEN SINGLE PIN DRIVE
all-CR : WAVEFORM RISE TIME WHEN ALL PIN DRIVE FIG. 20
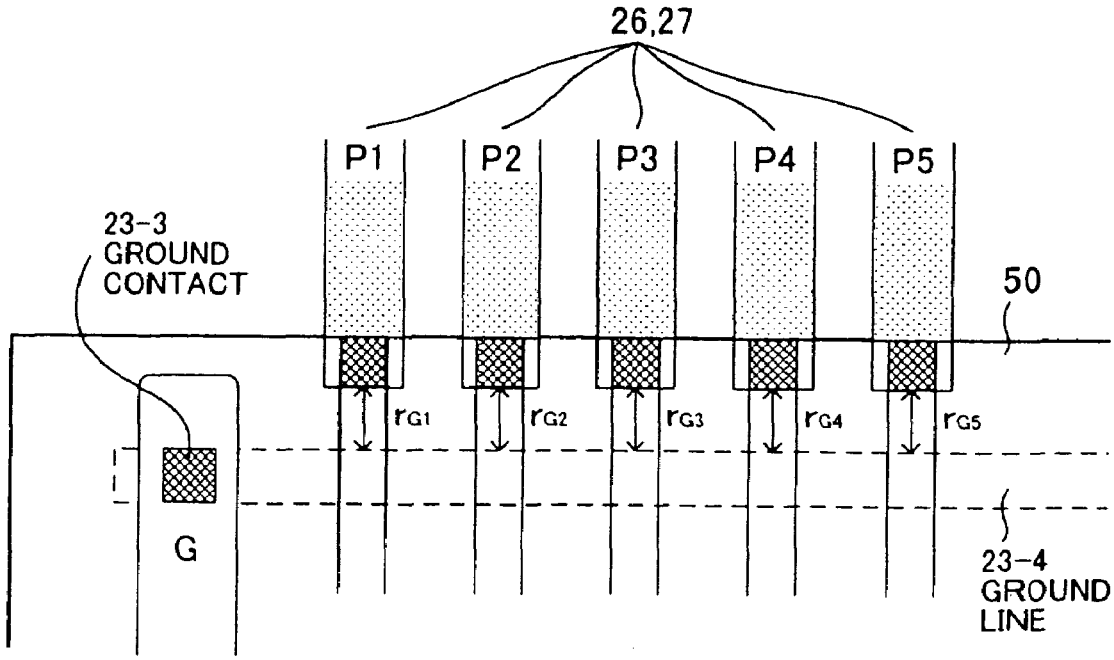
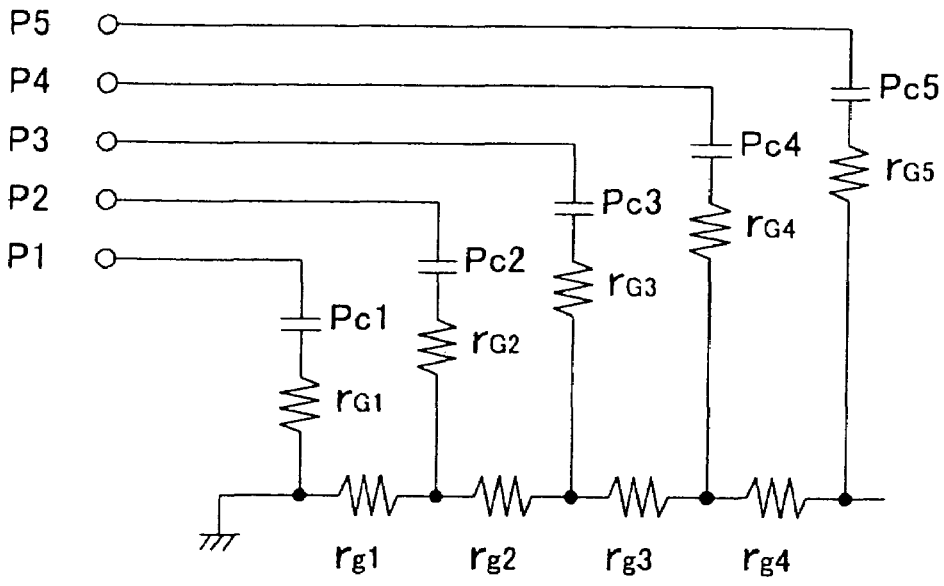
Pc1=Pc2=Pc3=Pc4=Pc5
rG1=rG2=rG3=rG4=rG5

| | | | |
|---|---|---|---|
| NOZZLE PITCH (m) | 1.70E-04 | | |
| THE NUMBER OF NOZZLES | 64 | | |
| COMMON ELECTRODE LENGTH (m) | 7.50E-04 | ←DISTANCE FROM GROUND LINE TO PZT CENTER | |
| GROUND LINE WIDTH (m) | 6.00E-04 (600 μm) | | |
| GROUND LINE THICKNESS (m) | 1.60E-06 | | |
| APPLIED VOLTAGE (V) | 20 | SINGLE PIN DRIVE (pF) | 208.152 |
| WAVEFORM RISE TIME (ns) | 50 | ALL PIN DRIVE (pF) | 13321.7 |

| CrTHICKNESS | 0.01 | 0.05 | 0.1 | 0.15 | 0.2 | 0.25 |
|---|---|---|---|---|---|---|
| 1-RESISTANCE | 63.2261 | 18.4025 | 12.7996 | 10.932 | 9.99814 | 9.43784 |
| 1-CR | 1.3E-08 | 3.8E-09 | 2.7E-09 | 2.3E-09 | 2.1E-09 | 2E-09 |
| 128-CR | 5.96E-08 | 5.03E-08 | 4.91E-08 | 4.9E-08 | 4.9E-08 | 4.8E-08 |

1-CR : WAVEFORM RISE TIME WHEN SINGLE PIN DRIVE
128-CR : WAVEFORM RISE TIME WHEN 128 PINS DRIVE

FIG. 24

| | |
|---|---|
| RESISTANCE Ni : $\rho$ ($\Omega$·m) | 7.24E-08 |

| | | | |
|---|---|---|---|
| NOZZLE PITCH (m) | 1.70E-04 | | |
| THE NUMBER OF NOZZLES | 64 | | |
| COMMON ELECTRODE LENGTH (m) | 7.50E-04 | ←DISTANCE FROM GROUND LINE TO PZT CENTER | |
| GROUND LINE WIDTH (m) | 6.00E-04 (600 $\mu$m) | | |
| GROUND LINE THICKNESS (m) | 1.00E-06 | | |
| APPLIED VOLTAGE (V) | 20 | SINGLE PIN DRIVE (pF) | 208.152 |
| WAVEFORM RISE TIME (ns) | 50 | ALL PIN DRIVE (pF) | 13321.7 |

| NiTHICKNESS | 0.002 | 0.01 | 0.05 | 0.1 | 0.15 | 0.2 |
|---|---|---|---|---|---|---|
| 1-RESISTANCE | 166.27 | 38.5054 | 12.9525 | 9.75838 | 8.69368 | 8.16133 |
| 1-CR | 3.5E-08 | 8E-09 | 2.7E-09 | 2E-09 | 1.8E-09 | 1.7E-09 |
| all-CR | 7.70E-08 | 5.04E-08 | 4.51E-08 | 4.4E-08 | 4.4E-08 | 4.4E-08 |

1-CR : WAVEFORM RISE TIME WHEN SINGLE PIN DRIVE
all-CR : WAVEFORM RISE TIME WHEN ALL PIN DRIVE

FIG. 25

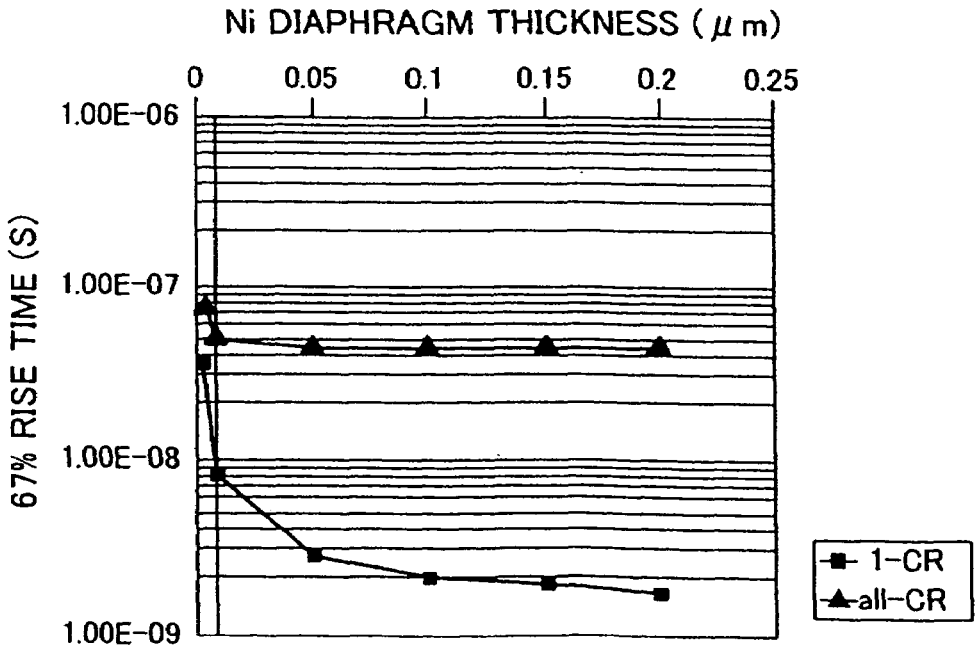

FIG. 26

| | |
|---|---|
| PRESSURE CHAMBER LENGTH Lc(m) | 5.00E-04 |
| SIGNAL LINE LENGTH Lsig | 1.00E-04 |
| PIEZO THICKNESS tp(m) | 1.00E-06 |
| PIEZO WIDTH wp(m) | 4.50E-05 |

| | |
|---|---|
| VACUUM PERMITTIVITY $\varepsilon 0$ | 8.85E-12 |
| PIEZO SPECIFIC PERMITTIVITY $\varepsilon / \varepsilon 0$ | 420 |

| | |
|---|---|
| PIEZO CAPACITANCE Cp(pF) | 100.359 |
| Cp= $\varepsilon$ *(Lv+Lsig)*wp/tp | |

| | |
|---|---|
| RESISTANCE Cr : $\rho$ ($\Omega$ ·m) | 1.27E-07 |

| | | | |
|---|---|---|---|
| NOZZLE PITCH (m) | 8.50E-05 | | |
| THE NUMBER OF NOZZLES PER SINGLE EARTH | 64 | | |
| COMMON ELECTRODE LENGTH (m) | 7.50E-04 | ←DISTANCE FROM GROUND LINE TO PZT CENTER | |
| GROUND LINE WIDTH (m) | 2.00E-04 (200 $\mu$m) | | |
| GROUND LINE THICKNESS (m) | 1.10E-06 | | |
| APPLIED VOLTAGE (V) | 20 | SINGLE PIN DRIVE (pF) | 100.359 |
| WAVEFORM RISE TIME (ns) | 50 | ALL PIN DRIVE (pF) | 6422.98 |

| CrTHICKNESS | 0.001 | 0.005 | 0.01 | 0.02 | 0.1 | 0.2 |
|---|---|---|---|---|---|---|
| 1-RESISTANCE | 1136.29 | 239.819 | 127.761 | 71.7312 | 26.9077 | 21.3048 |
| 1-CR | 1.1E-07 | 2.4E-08 | 1.3E-08 | 7.2E-09 | 2.7E-09 | 2.1E-09 |
| all-CR | 1.63E-07 | 7.29E-08 | 6.17E-08 | 5.60E-08 | 5.2E-08 | 5.1E-08 |

1-CR : WAVEFORM RISE TIME WHEN SINGLE PIN DRIVE
all-CR : WAVEFORM RISE TIME WHEN 128 PINS DRIVE

FIG. 28

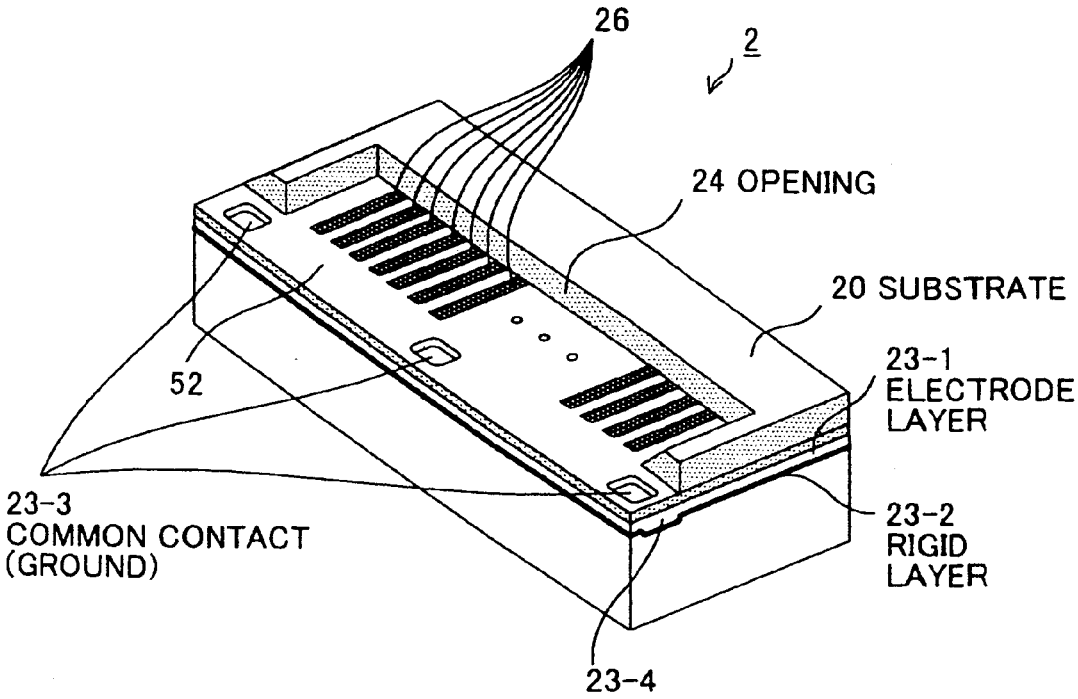

FIG. 29

| | | | |
|---|---|---|---|
| NOZZLE PITCH (m) | 1.70E-04 | | |
| THE NUMBER OF NOZZLES PER SINGLE EARTH | 43 | ←THREE POINTS ARE EARTHED AT 128 PINS | |
| COMMON ELECTRODE LENGTH (m) | 7.50E-04 | ←DISTANCE FROM GROUND LINE TO PZT CENTER | |
| GROUND LINE WIDTH (m) | 2.10E-04 (210μm) | | |
| GROUND LINE THICKNESS (m) | 5.00E-07 (0.5μm) | | |
| APPLIED VOLTAGE (V) | 20 | SINGLE PIN DRIVE (pF) | 208.152 |
| WAVEFORM RISE TIME (ns) | 50 | ALL PIN DRIVE (pF) | 8950.54 |

| CrTHICKNESS | 0.001 | 0.005 | 0.01 | 0.02 | 0.1 | 0.2 |
|---|---|---|---|---|---|---|
| 1-RESISTANCE | 571.346 | 123.111 | 67.0814 | 39.0667 | 16.655 | 13.8535 |
| 1-CR | 1.2E-07 | 2.6E-08 | 1.4E-08 | 8.1E-09 | 3.5E-09 | 2.9E-09 |
| all-CR | 1.66E-07 | 7.28E-08 | 6.11E-08 | 5.53E-08 | 5.1E-08 | 5.1E-08 |

1-CR : WAVEFORM RISE TIME WHEN SINGLE PIN DRIVE
all-CR : WAVEFORM RISE TIME WHEN 128 PINS DRIVE

FIG. 30

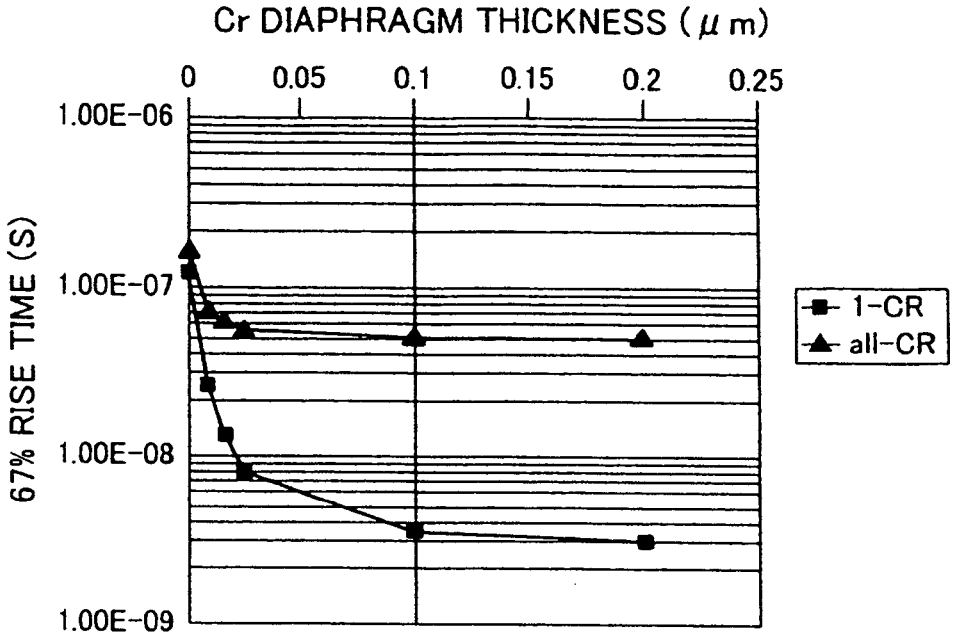

FIG. 31

| | |
|---|---|
| RESISTANCE Ni : ρ (Ω·m) | 7.24E-08 |

| | | | |
|---|---|---|---|
| NOZZLE PITCH (m) | 1.70E-04 | | |
| THE NUMBER OF NOZZLES | 43 | ← 128 PINS ARE EARTHED AT THREE POINTS | |
| COMMON ELECTRODE LENGTH (m) | 7.50E-04 | ←DISTANCE FROM GROUND LINE TO PZT CENTER | |
| GROUND LINE WIDTH (m) | 1.20E-04 (120 μm) | | |
| GROUND LINE THICKNESS (m) | 5.00E-07 (0.5 μm) | | |
| APPLIED VOLTAGE (V) | 20 | SINGLE PIN DRIVE (pF) | 208.152 |
| WAVEFORM RISE TIME (ns) | 50 | ALL PIN DRIVE (pF) | 8950.54 |

| NiTHICKNESS | 0.001 | 0.005 | 0.01 | 0.015 | 0.1 | 0.2 |
|---|---|---|---|---|---|---|
| 1-RESISTANCE | 330.438 | 74.9083 | 42.9671 | 32.32 | 14.22 | 12.623 |
| 1-CR | 6.9E-08 | 1.6E-08 | 8.9E-09 | 6.7E-09 | 3E-09 | 2.6E-09 |
| all-CR | 1.16E-07 | 6.26E-08 | 5.60E-08 | 5.38E-08 | 5E-08 | 5E-08 |

1-CR : WAVEFORM RISE TIME WHEN SINGLE PIN DRIVE
all-CR : WAVEFORM RISE TIME WHEN ALL PIN DRIVE

| CrTHICKNESS | 0.001 | 0.005 | 0.01 | 0.02 | 0.1 | 0.2 |
|---|---|---|---|---|---|---|
| 1-RESISTANCE | 1143.8 | 247.327 | 135.268 | 79.2387 | 34.4151 | 28.8122 |
| 1-CR | 1.1E-07 | 2.5E-08 | 1.4E-08 | 8E-09 | 3.5E-09 | 2.9E-09 |
| all-CR | 1.63E-07 | 7.26E-08 | 6.13E-08 | 5.57E-08 | 5.1E-08 | 5.1E-08 |

1-CR : WAVEFORM RISE TIME WHEN SINGLE PIN DRIVE
all-CR : WAVEFORM RISE TIME WHEN 150 PINS DRIVE

MULTI-NOZZLE INK JET HEAD

This application is a divisional of U.S. patent application Ser. No. 11/097,138, filed Apr. 4, 2005 now U.S. Pat. No. 7,168,793, which was a divisional of U.S. patent application Ser. No. 10/807,175, filed Mar. 24, 2004 now U.S. Pat. No. 6,902,263, which was a divisional application of U.S. patent application Ser. No. 10/254,782, filed Sep. 26,2002 now abandoned, which is a continuation of International application No. PCT/JP00/02137 filed Mar. 31, 2000.

TECHNICAL FIELD

The present invention relates to a multi-nozzle ink jet head having a plurality of nozzles, and in particular to a multi-nozzle ink jet head in which are combined thin-film piezoelectric bodies and a diaphragm having a multi-layer structure.

BACKGROUND ART

An ink jet head has nozzles, ink chambers, an ink supply system, an ink tank, and transducers. By transmitting displacement/pressure generated by the transducers to the ink chambers, ink particles are ejected from the nozzles, therefore characters or images are recorded on a recording medium such as paper.

In a well-known form, a thin-plate-shaped piezoelectric element having the whole of one surface thereof bonded to the outer wall of an ink chamber is used as each transducer. A pulse-like voltage is applied to the piezoelectric element, thus bending the composite plate comprising the piezoelectric element and the outer wall of the ink chamber, and the displacement/pressure generated through the bending is transmitted to the inside of the ink chamber via the outer wall of the ink chamber.

A sectioned perspective view of a conventional ink jet head using such piezoelectric elements is shown in FIG. 37. As shown in FIG. 37, the head is constituted from piezoelectric bodies 90, individual electrodes 91 formed on the piezoelectric bodies 90, a nozzle plate 93 in which are provided nozzles 92, ink chamber walls 95 made of a metal or a resin that, along with the nozzle plate 93, form ink chambers 94 corresponding respectively to the nozzles 92, and a diaphragm 96.

The nozzles 92 and the diaphragms 96 each correspond to the ink chambers 94; the periphery of the diaphragm 96 is connected strongly to the periphery of the corresponding ink chamber 94, and each piezoelectric body 90 deforms the corresponding diaphragm 96 as shown by the dashed lines in the drawing.

Regarding the application of voltages to the piezoelectric bodies 90, the diaphragm 96 is taken as a common electrode and is earthed, and electrical signals from a printing apparatus main body are applied separately to the individual electrodes 91 via a printed circuit board, not shown.

Regarding the formation of the piezoelectric bodies on the head, the most common method has been to bond on plate-shaped piezoelectric bodies in positions corresponding to the ink chambers 94, or to bond a piezoelectric body that spans a plurality of ink chambers in a position corresponding to the ink chambers, and then divide this piezoelectric body into individual piezoelectric bodies by cutting away or the like. With such head formation, in the case of forming thin piezoelectric bodies (<50 μm), there have been problems in that fluctuations in the thickness of the adhesive result in fluctuations in the characteristics, and hence the head driving characteristics deteriorate, and moreover bonding may not be possible (splitting may occur during bonding).

In contrast with the above method, it has been proposed to form a head with thin-film piezoelectric bodies by forming actuator parts comprising the piezoelectric bodies on a substrate, forming the pressure chambers, and then removing the substrate from the part that contributes to ink ejection.

With a bimorph type ink jet head using thin-film piezoelectric bodies as described above, the characteristics of the piezoelectric elements can be improved even though they are thin films, and in particular a high-density multi-nozzle head can be realized. Moreover, with this thin-film head, to obtain the very best actuator performance, it is necessary to carry out optimization of the diaphragm (thickness, hardness, electrical characteristics).

Moreover, to optimize the diaphragm, making the diaphragm be a multi-layer structure of an electrode and a diaphragm has been proposed from hitherto (for example, Japanese Patent Application Laid-open No. H7-81070). However, with this conventional multi-layer constitution proposal, the functioning of the electrode is improved, but consideration has not been given to optimization as a diaphragm for thin-film piezoelectric elements.

That is, to apply a multi-layer diaphragm to thin-film piezoelectric elements, when making the piezoelectric elements be thin films, it is necessary to also make the diaphragm (including the electrode) thin. In this case, with the piezoelectric elements being made to be thin films, the driving force/generated force of the piezoelectric elements becomes low, and to obtain the maximum volume change/generated pressure from the pressure chambers in this case, it is necessary to optimize the (mechanical) characteristics of the diaphragm, which inhibits the expansion and contraction of the elements.

Separate to this, considering optimization as an electrode, it is necessary to aim for optimization in both mechanical and electrical respects.

With the conventional proposal, these two are functionally separated, with the diaphragm having a multi-layer structure in which the electrical part is an electrode layer and the mechanical part is a rigid layer, but no consideration is given to making the diaphragm a thin film, and hence it is difficult to realize a diaphragm that is optimal for thin-film piezoelectric elements.

DISCLOSURE OF THE INVENTION

It is an object of the present invention to provide a multi-nozzle ink jet head having a diaphragm for effectively linking a small thin-film piezoelectric element driving force to ink ejection.

It is another object of the present invention to provide a multi-nozzle ink jet head for effectively utilizing the thin-film piezoelectric element driving force even if the diaphragm is made thin.

It is yet another object of the present invention to provide a multi-nozzle ink jet head for preventing blunting of the driving waveform even if the diaphragm is made thin.

It is yet another object of the present invention to provide a multi-nozzle ink jet head for preventing a time lag in ink ejection regardless of the number of driving elements even if the diaphragm is made thin.

To attain these objects, one form of the multi-nozzle ink jet head of the present invention has a head substrate in which are formed a plurality of nozzles and a plurality of pressure chambers, a diaphragm that comprises a common electrode layer and a rigid layer and covers each of the plurality of pressure chambers, a plurality of piezoelectric elements provided in correspondence with the pressure chambers on the diaphragm, and a plurality of individual electrodes provided in correspondence with the piezoelectric elements on the piezoelectric elements, wherein the thickness of the common electrode layer is within a range such that the lag in the rise time of the driving waveform when driving all of the piezoelectric elements of the head relative to the rise time of the driving waveform when driving a single one of the piezoelectric elements results in ink drops impacted on recording paper being shifted by not more than half a dot.

With the thin-film piezoelectric bodies targeted by the present invention, if the diaphragm is thick, then distortion of the thin-film piezoelectric bodies will not arise. It is thus necessary to make the diaphragm thin, but if the diaphragm is merely made thin, then the desired mechanical characteristics (displacement characteristics) will not be obtained. A basic idea of the present invention is thus to use a multi-layer diaphragm separated into an electrode layer and a rigid layer, and to make the electrode layer, which acts as a common electrode, as thin as possible and optimize the mechanical characteristics through selection of the material (Young's modulus etc.) and adjustment of the thickness of the rigid layer.

Secondly, if the electrode layer is merely made thin, then with a multi-nozzle head, the following problems will arise. Accompanying increases in detail and resolution, it has come to be that there are greater demands on miniaturizing the ink drops and on the accuracy of the impact position, and hence variations in the size and position of dots between during single-pin (single-nozzle) driving and during all-pin (all-nozzle) driving due to (mechanical/electrical) cross talk has become a problem. For example, when forming minute dots, in the case that the ink drops are 1.5 pl, the diameter of the dots on the recording paper (ink jet specialist paper) is about 12 μm, and in the case that the ink drops are 5 pl, about 30 μm. In the case of increasing the detail by reducing the dot diameter, it is necessary to shift to high-speed driving (i.e. to increase the frequency of flying particle formation) so as to shorten the printing time. If the driving frequency increases, then the speed of movement of the head also increases of necessity, and hence if an electrical lag (bluntness of the driving waveform) occurs, then a lag in the ejection time and a drop in the flight speed will occur, and hence shifting of the dot position on the recording paper will occur.

For example, in the case of making the gap between the nozzles and the recording paper very small so that the drop in the flight speed does not have much effect, if the ink flight frequency is made to be 40 kHz in printing at 1.5 pl, then with a lag in the driving waveform of about 50 ns there will be a shift of 1 dot. In the case of 5 pl, there will be a shift of half a dot.

With a multi-nozzle head specified to have the current minimum flight flow amount (minimum flow amount 5 pl, particle formation frequency 20 kHz), the carriage speed of the head is different to that of the printer of the explanation of the shift of the flying dots above (the carriage speed slows down from 40 kHz to 20 kHz), but shifting of the dot position due to a lag in the rise of the waveform similarly occurs, and hence even if the metal layer used as the common electrode is made as thin as possible, this thickness should still be selected so as to minimize the positional shift due to the electrical effect described above.

In the present form of the present invention, the thickness of the electrode layer is selected, considering the volume resistivity and so on of the metal used, such that the positional shift of the smallest dots between during single-pin driving and during all-pin driving is half a dot or less (for example, such that the electrical lag is 50 ns or less).

Of course, if the head specifications (minimum ink flight amount, flight speed etc.) are different to those of the head described above, then the permissible value of the lag in the rise of the input waveform will change. For example, with the above-mentioned 1.5 pl/40 kHz head, 25 ns or less is required, but with a head for which ink drops of more than 5 pl fly, acceptable printing results can be obtained even with a lag of 50 ns or more.

As a result of the above, the dot shift can be minimized to that required of the multi-nozzle head while giving sufficient mechanical characteristics. That is, it becomes possible to increase the detail and the speed for a head that uses thin-film piezoelectric bodies.

Moreover, with the multi-nozzle ink jet head of the present form of the present invention, by making the thickness of the common electrode layer be within a range such that the time for the driving waveform to rise to 67% of an ideal waveform results in a positional shift of not more than half a dot for the smallest dots specified, i.e. by making even the driving lag be within a permissible range, good printing results can be obtained.

Furthermore, with the multi-nozzle ink jet head of the present form of the present invention, by making the thickness of the common electrode layer be 0.1 μm, formation of the electrode layer also becomes easy.

The multi-nozzle ink jet head of another form of the present invention has a head substrate in which are formed a plurality of nozzles and a plurality of pressure chambers, a diaphragm that comprises a common electrode layer and a rigid layer and covers each of the plurality of pressure chambers, a plurality of piezoelectric elements provided in correspondence with the pressure chambers on the diaphragm, and a plurality of individual electrodes provided in correspondence with the piezoelectric elements on the piezoelectric elements, wherein the common electrode layer has 3 or more earth contacts.

With this form of the present invention, because the lag in the waveform between all-pin driving and single-pin driving is determined by the number of piezoelectric body elements for each earth contact, and an increase in the capacitance is the main cause of the wave form being blunted, as a method of distributing this, the number of earth contacts is increased from the conventional 2 points at the left and right respectively of the row of piezoelectric bodies to 3 or more points, thus suppressing the blunting of the waveform.

Moreover, with this form of the present invention, by providing a plurality of contact parts for exposing the earth contacts of the common electrode layer from the head, the number of earth contacts can easily be made a plurality.

The multi-nozzle ink jet head of yet another form of the present invention has a head substrate in which are formed a plurality of nozzles and a plurality of pressure chambers, a diaphragm that comprises a common electrode layer and a rigid layer and covers each of the plurality of pressure chambers, a plurality of piezoelectric elements provided in correspondence with the pressure chambers on the diaphragm, and a plurality of individual electrodes provided in correspondence with the piezoelectric elements on the piezoelectric elements, wherein a low-resistance layer is provided on the common electrode layer in a position parallel to a row of the piezoelectric elements.

With this form, as a further advance over the structure having several earth contacts, a conductor (low-resistance) line (ground line) is formed in a position parallel to the piezoelectric body row and in close contact (integrated) with the metal layer of the diaphragm, and as a result the constitution is such that the distance from the earth contacts at each end of the piezoelectric body row can be considered to be approximately the same for both single-pin driving and all-pin driving.

Moreover, with the multi-nozzle ink jet head of the present form of the present invention, by making the common electrode layer have a plurality of earth contacts, changes in the capacitance according to the number of elements driven can be suppressed. That is, to lessen the burden in terms of fabrication of the ground line formed, the number of earth contacts from the outside is made to be several, and the thickness and width of the ground line are reduced. Reducing the thickness contributes to shortening the process time (i.e. increasing the ability to carry out mass production), and reducing the width greatly contributes to the number of components that can be obtained (i.e. reducing the cost).

Furthermore, with the multi-nozzle ink jet head of the present form of the present invention, a plurality of contact parts are provided for exposing the earth contacts of the common electrode layer from the head.

Furthermore, with the multi-nozzle ink jet head of the present form of the present invention, the plurality of contact parts are provided on the low-resistance layer.

Other objects and forms of the present invention will become apparent from the following description of best modes of the invention and the drawings.

BRIEF DESCRIPTION OF THE DRAWINGS

FIG. 5 is a diagram for explaining blunting of a driving waveform.

FIG. 6 consists of tables for explaining the case of applying to a 150 dpi, 128-pin head as an example of the head of FIG. 2.

FIG. 7 is a table of rise characteristics for the head of FIG. 6.

FIG. 20 is an equivalent circuit diagram for the head of FIG. 19.

FIG. 24 is a table of rise characteristics for another example of the head of FIG. 19.

FIG. 25 is a graph showing the relationship between thickness and rise time for the head of the other example of FIG. 19.

FIG. 26 is a table of rise characteristics for yet another example of the head of FIG. 19.

FIG. 28 is a sectioned perspective view of an ink jet head of a fourth embodiment of the present invention.

FIG. 29 is a table of rise characteristics for an example of the head of FIG. 28.

FIG. 30 is a graph showing the relationship between thickness and rise time for the head of the example of FIG. 29.

FIG. 31 is a table of rise characteristics for another example of the head of FIG. 28.

BEST MODE FOR CARRYING OUT THE INVENTION

Figure 1:
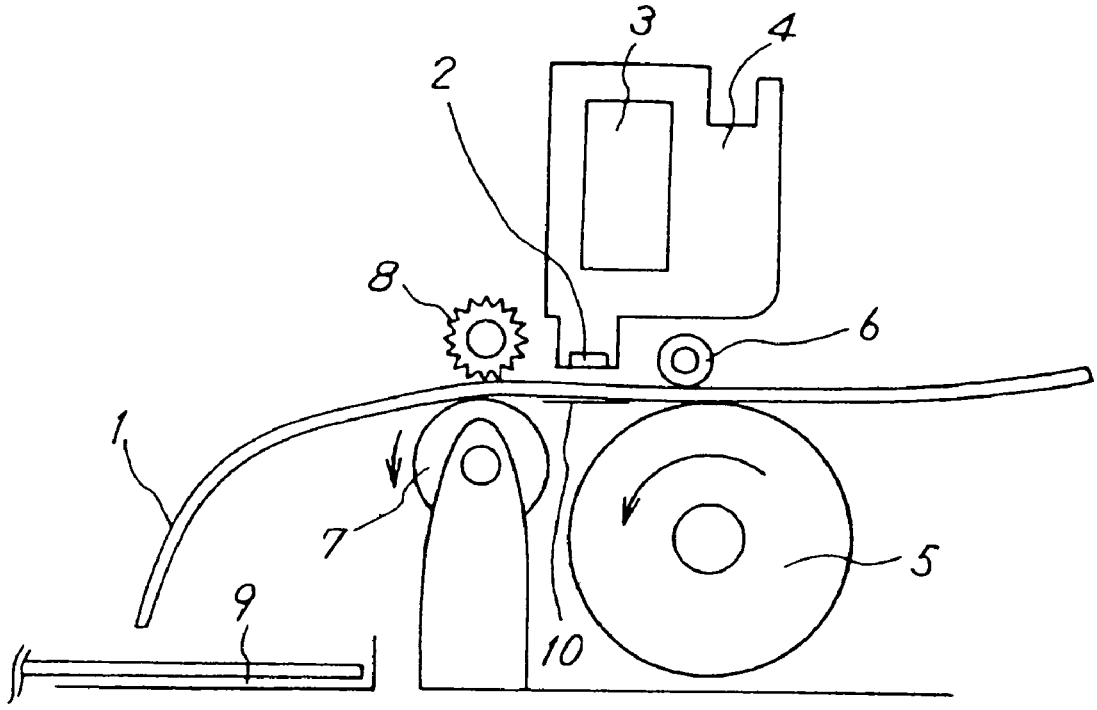
FIG. 1 is a side view of an ink jet recording apparatus to which the ink jet head of the present invention is applied.

FIG. 1 is a side view of an ink jet recording apparatus using the multi-nozzle ink jet head (hereinafter referred to as the 'head') of the present invention. In FIG. 1, '1' is a recording medium, on which processing such as printing is carried out using the ink jet recording apparatus. '2' is the ink jet head, which ejects ink onto the recording medium 1. '3' is an ink tank, which supplies ink to the ink jet head. '4' is a carriage, which has therein the ink jet head 2 and the ink tank 3.

'5' is a feeding roller, and '6' is a pinch roller; these sandwich the recording medium 1 and convey it towards the ink jet head 2. '7' is a discharge roller, and '8' is a pinch roller; these sandwich the recording medium 1, and convey it in a discharge direction. '9' is a stacker, which receives the discharged recording medium 1. '10' is a platen, which pushes against the recording medium 1.

With this ink jet head 2, processing such as printing is carried out on the medium by applying voltages to expand and contract piezoelectric elements and eject ink through the pressure thus generated.

First Embodiment

Figure 2:
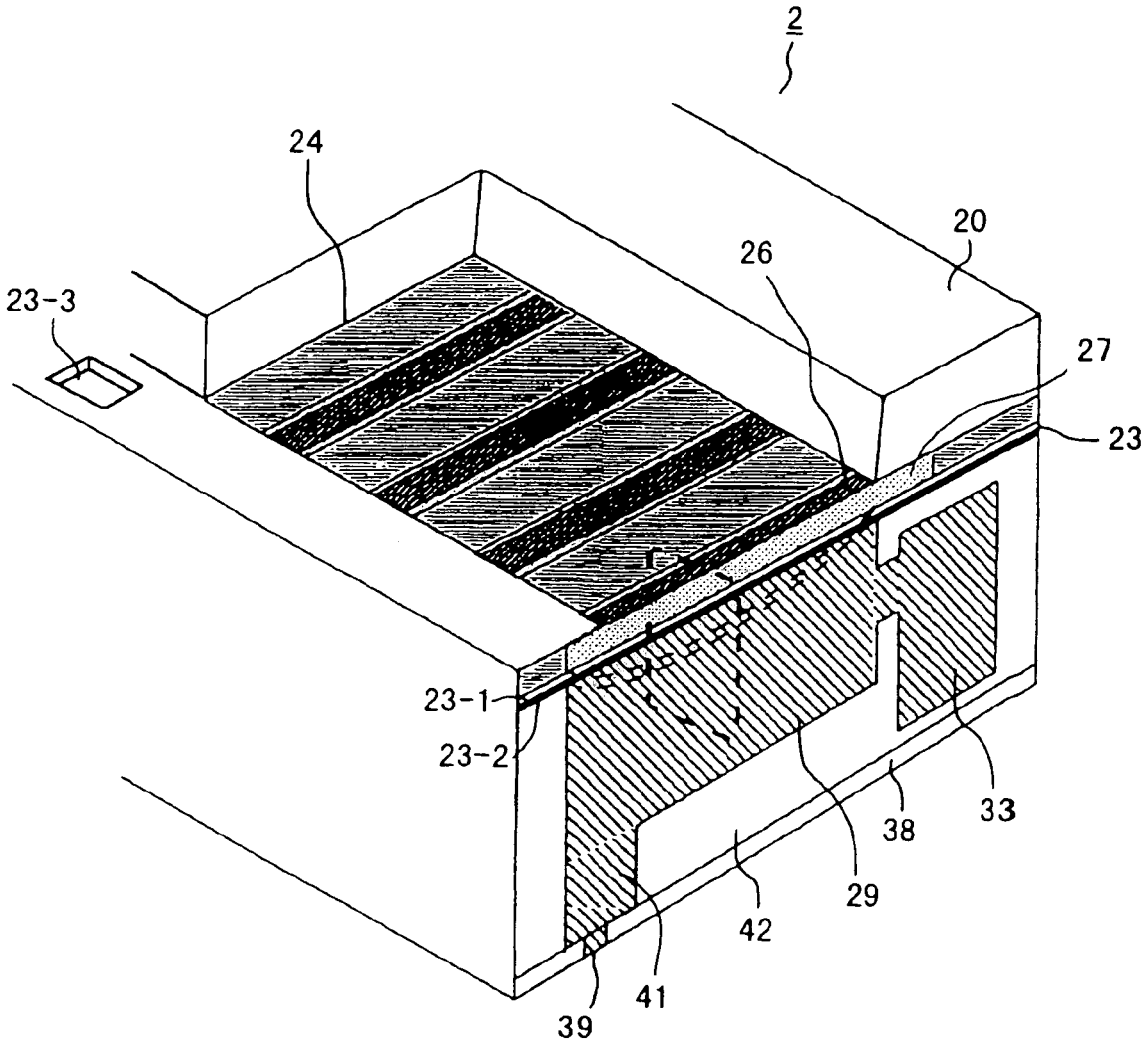
FIG. 2 is a sectioned perspective view of an ink jet head of a first embodiment of the present invention.

FIG. 2 is a sectioned perspective view of the ink jet head 2 of a first embodiment of the present invention. Firstly, a description will be given of the constitution of the ink jet head 2 using FIG. 2. Broadly speaking, the ink jet head 2 is constituted from a substrate 20, a diaphragm 23, a main body part 42, a nozzle plate 38, ink ejection energy generating parts (hereinafter referred to as the 'energy generating parts') and so on.

The main body part 42 has a structure in which dry films are laminated as will be described later, and inside thereof are formed a plurality of pressure chambers 29 (ink chambers) and an ink channel 33 that acts as a supply channel for the ink. Moreover, the top part in the drawing of each pressure chamber 29 is made to be a free part, and an ink lead-through channel 41 is formed in the bottom surface of each pressure chamber 29.

Moreover, the nozzle plate 38 is disposed on the bottom surface in the drawing of the main body part 42, and the diaphragm 23 is disposed on the top surface of the main body part 42. The nozzle plate 38 is made for example of stainless steel, and has nozzles 39 formed therein in positions facing the ink lead-through channels 41.

Moreover, the diaphragm 23 is a plate-shaped member having a laminated structure of an electrode layer 23-1, which is made for example of chromium (Cr) or Ni, and a rigid layer 23-2, which is made of TiN, SiC or the like. The substrate 20 and the energy generating parts are disposed on top of the diaphragm 23. The substrate 20 is made for example of magnesium oxide (MgO), and an opening part 24 is formed in a central position thereof. The energy generating parts are formed on the diaphragm 23 so as to be exposed via the opening part 24.

Each energy generating part is constituted from the above-mentioned diaphragm 23 (the common electrode 23-1), an individual electrode 26, and a piezoelectric body 27. The energy generating parts are formed in positions corresponding to the positions of formation of the pressure chambers 29, a plurality of which are formed in the main body part 42.

The individual electrodes 26 are made for example of platinum (Pt), and are formed on the top surfaces of the piezoelectric bodies 27. Moreover, the piezoelectric bodies 27 are crystalline bodies that generate piezoelectricity, and in the present example the constitution is such that each is formed independently in the position of formation of the respective pressure chamber 29 (i.e. neighboring energy generating parts are not connected to one another).

In the ink jet head 2 having the above constitution, when a voltage is applied between the common electrode 23-1 and an individual electrode 26, then distortion is generated in the piezoelectric body 27 due to the phenomenon of piezoelectricity. Even though distortion is generated in the piezoelectric body 27 in this way, the diaphragm 23, which is a rigid body, tries to maintain its state; consequently, in the case for example that the piezoelectric body 27 distorts in a direction so as to contract through the application of the voltage, then deformation occurs such that the diaphragm 23 side becomes convex. The diaphragm 23 is fixed at the periphery of the pressure chamber 29, and hence the diaphragm 23 deforms into a shape that is convex towards the pressure chamber 29, as shown by the dashed lines in the drawing.

Consequently, due to the deformation of the diaphragm 23 accompanying the distortion of the piezoelectric body 27, the ink in the pressure chamber 29 is pressurized, and hence is ejected to the outside via the ink lead-through channel 41 and the nozzle 39, and as a result printing is carried out on the recording medium.

In the case of the above constitution, the ink jet head 2 according to the present embodiment is characterized in that the diaphragm 23 and the energy generating parts (individual electrodes 26 and piezoelectric bodies 27) are formed using thin film formation technology (the manufacturing method will be described in detail later).

By forming the diaphragm 23 and the energy generating parts using thin film formation technology in this way, it is possible to form thin (50 μm or less) miniaturized energy generating parts with high precision and high reliability. It is thus possible to reduce the power consumption of the ink jet head 2, and moreover high-resolution printing can be made possible.

Moreover, with the present embodiment, the constitution is such that the energy generating parts are divided, with each energy generating part being in a position corresponding to one of the pressure chambers 29. Each energy generating part can thus displace without being constrained by the neighboring energy generating parts. The applied voltage required for ink ejection can thus be reduced, and hence the power consumption of the ink jet head 2 can also be reduced due to this.

With such a thin-film piezoelectric body 27 of thickness 50 μm or less, if the diaphragm 23 is thick, then distortion of the thin-film piezoelectric body 27 will not arise, and hence it is necessary to make the diaphragm 23 thin. However, if the diaphragm is merely made thin, then the desired mechanical characteristics (displacement characteristics) will not be obtained. A multi-layer diaphragm in which the electrode layer 23-1 and the rigid layer 23-2 are separate is thus used, and the electrode layer 23-1, which is the common electrode, is made to be as thin as possible, with the optimization of the mechanical characteristics being carried out through selection of the material (Young's modulus etc.) and thickness of the rigid layer 23-2.

Next, if the electrode layer 23-1 is merely made thin, then with a multi-nozzle head, a shift in the dot impact position between single-pin driving and all-pin driving will arise. That is, accompanying increases in detail and resolution, it has come to be that there are greater demands on miniaturizing the ink drops and on the accuracy of the impact position, and hence variations in the size and position of dots between during single-pin (single-nozzle) driving and during all-pin (all-nozzle) driving due to (mechanical/electrical) cross talk has become a problem. For example, when forming minute dots, in the case that the ink drops are 1.5 pl, the diameter of the dots on the recording paper (ink jet specialist paper) is about 12 μm, and in the case that the ink drops are 5 pl, about 30 μm. In the case of increasing the detail by reducing the dot diameter, it is necessary to shift to high-speed driving (i.e. to increase the frequency of flying particle formation) so as to shorten the printing time.

When the driving frequency increases, then the speed of movement of the head also increases of necessity, and hence if an electrical lag (bluntness of the driving waveform) occurs, then a lag in the ejection time and a drop in the flight speed will occur, and hence shifting of the dot position on the recording paper will occur. For example, in the case of printing at 1.5 pl as described above, if the ink flight frequency is made to be 40 kHz (assuming that there is no change in the ink flight speed), then if the lag in the driving waveform is about 50 ns, there will be a shift of 1 dot. In the case of 5 pl, there will be a shift of half a dot.

With the multi-nozzle head, it is thus necessary to contrive the constitution such that the metal layer 23-1 (the common electrode) is as thin as possible, but within a range such that the electrical lag is acceptable. In the present embodiment of the present invention, the thickness of the electrode layer is selected, considering the volume resistivity and so on of the metal used, such that the dot shift on the recording paper due to the electrical lag between during single-pin driving and during all-pin driving is half a dot or less at 5 pl.

Figure 3:
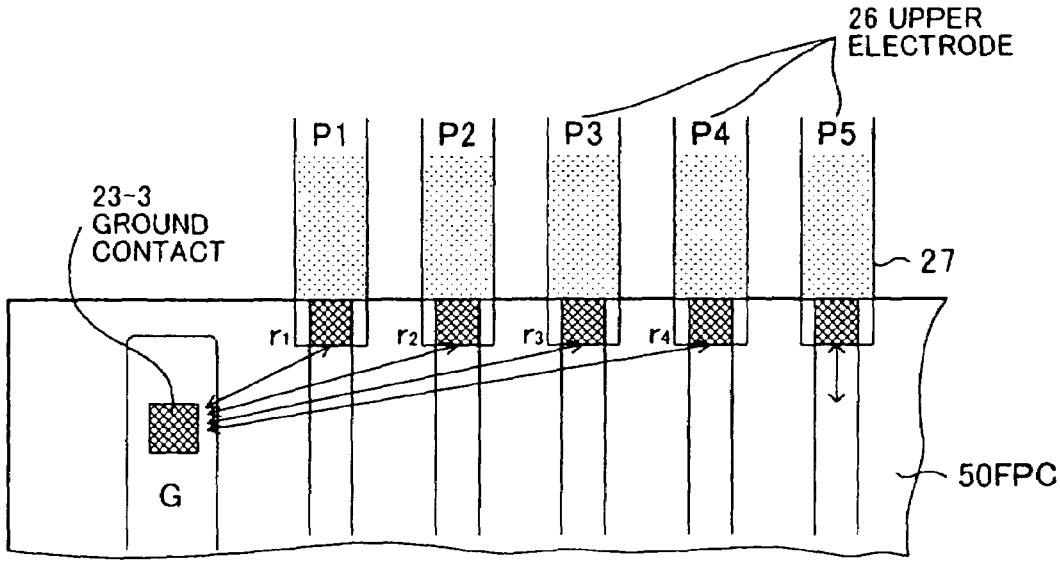
FIG. 3 is a drawing for explaining the head of FIG. 2.
Figure 4:
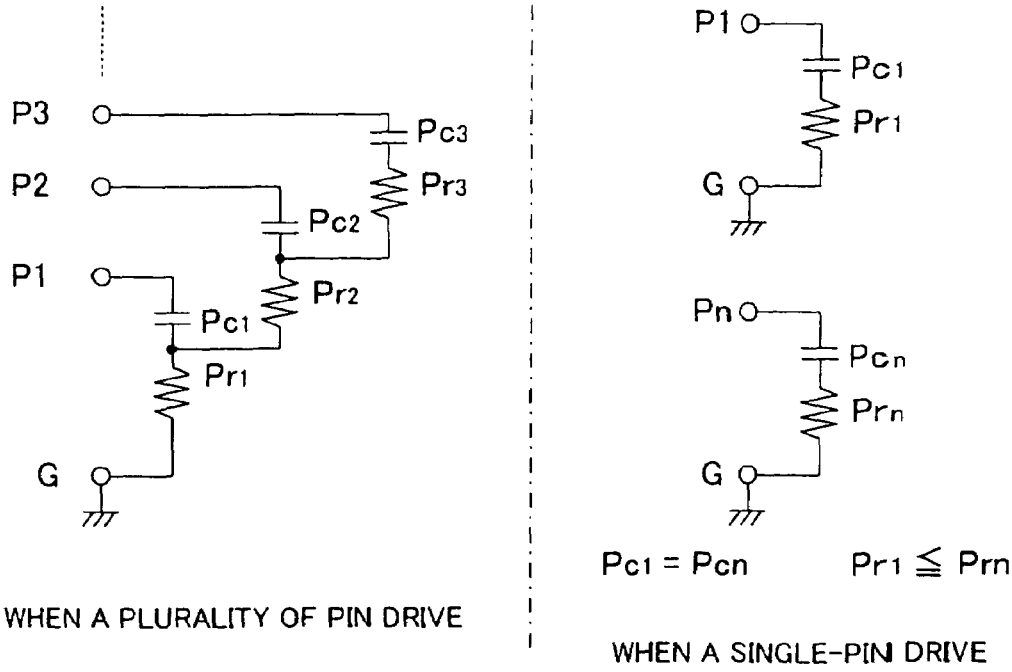
FIG. 4 consists of equivalent circuit diagrams for FIG. 3.

Following is an explanation of the above-mentioned electrical lag using FIGS. 3 and 4. FIG. 3 is a drawing showing the positional relationship between the row of piezoelectric bodies and a ground contact 23-3. As described earlier, the electrode layer 23-1 of the diaphragm 23 is an electrode common to all of the piezoelectric elements 27, and as shown in FIGS. 2 and 3, the ground contact 23-3 is exposed from the head 2. As shown in FIG. 3, connection is carried out such that the pattern of a connecting cable (FPC) 50 for connecting to external circuitry applies separate driving signals to the individual electrode 26 of each of the piezoelectric elements 27, and in the common electrode 23-1 the ground contact 23-3 is connected to the earth.

The distance from the ground contact 23-3 to each of the piezoelectric elements 27 varies according to the position of the piezoelectric element 27, being r1, r2, r3, r4 etc. as shown in FIG. 3. Moreover, the electrical capacitance components for the piezoelectric elements 27 are Pc1 to Pcn, and the common electrode 23-1 has resistance components of Pr1 to Prn, and hence integration circuits comprising a resistor and a capacitor are effectively inserted between the ground contact 23-3 (G) and each of the individual electrodes 26.

Consequently, in the case of single-pin (single-nozzle) driving, as shown on the right in FIG. 4, a single integration circuit is formed between the selected individual electrode 26 and the ground G, and hence the lag in the driving waveform due to the integral action is the same for each of the pins, and moreover is small. However, in the case of multi-pin (multi-nozzle) driving, as shown on the left in FIG. 4, a pin far from the ground contact 23-3 is connected to the ground contact 23-3 via the resistance of the distance between the pin and the ground contact 23-3.

For example, pin P3 is earthed to the ground via the resistances Pr3', Pr2' and Pr1'. Consequently, the further the pin is from the ground contact, the larger the integration constant, this being due to the increase in the resistance.

As shown in FIG. 5, due to this integral element, the rise of the applied driving waveform is blunted compared with an ideal rectangular waveform. The characteristics of this blunting of the rise vary according to the integration constant; as described above, in the case that a plurality of pins are driven, the further the pin is from the ground contact 23-3, the slower the rise time becomes, and hence differences arise in the ink ejection time and the ink flight speed.

Due to this effect, the difference between the lag in the rise when the single pin furthest from the ground contact is driven and the lag in the rise for this pin when all of the pins connected to the ground contact are driven is the maximum such difference. In the case of a head (printer) in the state described above, if this difference is more than 50 ns, then the dot position will shift by more than half a dot depending on the number of pins driven in the head, even though the same nozzle is the same. With an integration circuit, the rise time is defined as the time CR taken to reach 67% of the voltage of the ideal waveform, as shown in FIG. 5.

It is thus necessary to design the integration circuits such that the time CR is such that the shift in the dot diameter formed by the smallest particles at the target specifications is half a dot or less. With the multi-nozzle head described above, the capacitance of the piezoelectric elements 27 does not vary according to the material and so on of the elements, and hence it is necessary to adjust the time CR through the resistance, i.e. through the thickness and material of the common electrode 23-1.

With a diaphragm in which the functions are separated as described earlier, the thinner the common electrode 23-1, the better. However, in general, the thinner a metal layer, the higher the resistance value becomes, and hence if the common electrode 23-1 is merely made thin, then it will not be possible to satisfy the 50 ns condition described above.

Studies were thus carried out into an electrode layer that is as thin as possible while still satisfying the 50 ns-or-less condition described above. As a result, the dot shift can be kept down to that required of the multi-nozzle head, i.e. 1 dot or less, while giving sufficient mechanical characteristics through the rigid layer 23-2. That is, it becomes possible to increase the detail and the speed for a head that uses thin-film piezoelectric bodies.

Next, examples of the above embodiment of the present invention will be described.

EXAMPLE 1

FIG. 6 stipulates the size, material and so on for each element in the specifications of a 150 dpi multi-nozzle head for which the minimum particle amount is made to be 1.5 pl and the driving frequency 20 kHz. The permitted waveform lag with this head is 50 ns. This head is the high-density head of FIG. 2 having a nozzle pitch of 170 μm, with the width of the pressure chambers 29 being made to be 100 μm and the length 700 μm, and the thickness of the piezos (piezoelectric elements) 27 being made to be 1 μm and the width 70 μm.

The capacitance of the piezos was made to be 208.152 pF, and Cr (resistivity 1.27 μΩ·m) was used as the common electrode layer 23-1. The number of nozzles was 64 pins, and a ground contact 23-3 was provided at each end of the row of nozzles. With an applied voltage of 20V, the thickness of the electrode layer 23-1 was changed, and the rise time CR of the driving waveform was calculated.

Note that a method was adopted in which an earth is led out to the outside at each end of the row of piezoelectric bodies from the electrode layer 23-1 at the front.

Figures 8, 9:
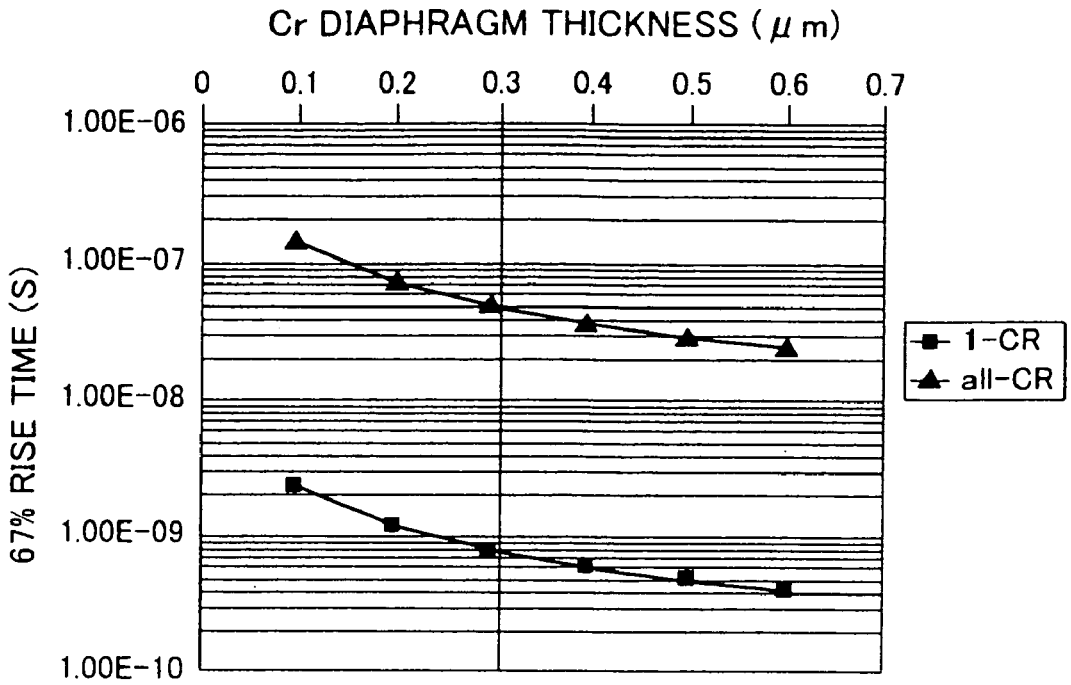
FIG. 8 is a graph showing the relationship between thickness and rise time for the head of FIG. 6.
FIG. 9 is a table of rise characteristics for another example of the head of FIG. 2.

FIG. 7 shows calculation results of the resistance value, the rise time 1-CR during 1-pin driving, and the waveform rise time all-CR during all-pin driving for each thickness of the electrode layer, and FIG. 8 is a graph of these results. The results show that there are no electrical problems if the thickness of the electrode layer 23-1 is about 0.3 μm, and hence when studying the multi-layer diaphragm structure, one should fix the thickness of the metal layer at 0.3 μm, and then adopt the thickness of the rigid layer used that is optimal for the characteristics. Note that the 1-CR is smaller by at least one decimal place and may thus be taken as zero, and hence a thickness is selected for which the all-CR is 50 ns or less.

EXAMPLE 2

Figure 10:
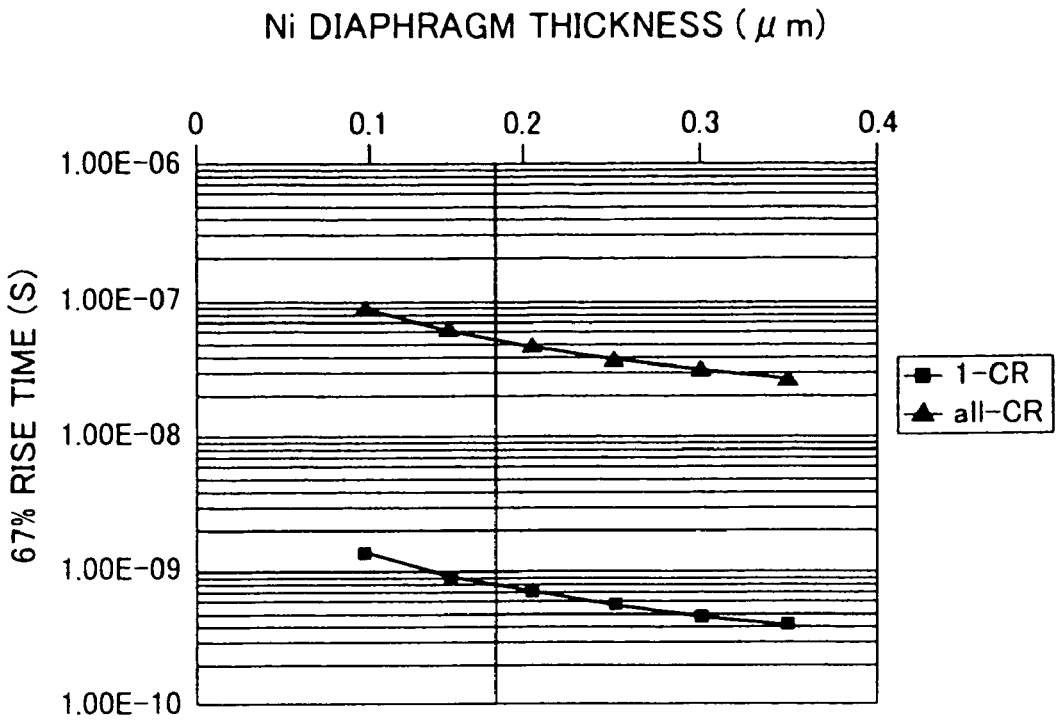
FIG. 10 is a graph showing the relationship between thickness and rise time for the head of the other example of FIG. 9.

In a 150-dpi head of the constitution of FIG. 6, Ni (resistivity 0.724 μΩ·m) was used as the electrode layer 23-1. FIG. 9 shows calculation results of the resistance value, the waveform rise time 1-CR during 1-pin driving, and the waveform rise time all-CR during all-pin driving for thicknesses of the Ni from 0.1 to 0.35, and FIG. 10 is a graph of these results.

According to the results, with the Ni electrode layer, because the resistivity is lower than in the case of Cr, there are no electrical problems if the thickness of the electrode layer is about 0.18 μm.

Next, a method of manufacturing the ink jet head 2 having the constitution described above will be described using FIGS. 11 to 13.

Figure 11A:
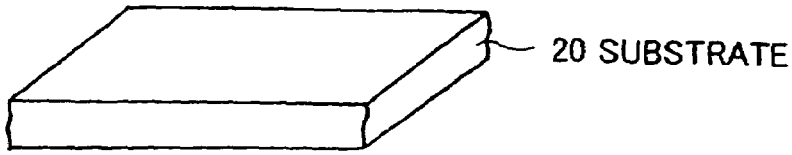
FIGS. 11 (A), 11 (B), 11 (C), 11 (D) and 11 (E) consist of (first) explanatory drawings of a manufacturing process of the head of FIG. 2.

To manufacture the ink jet recording head 2, firstly a substrate 20 is prepared as shown in FIG. 11(A). In the present example, a magnesium oxide (MgO) monocrystal of thickness 0.3 mm is used as the substrate 20.

Figure 11B:
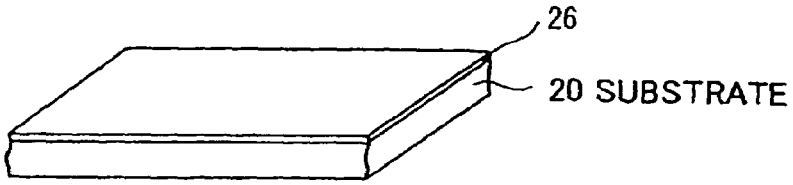
Figure 11C:
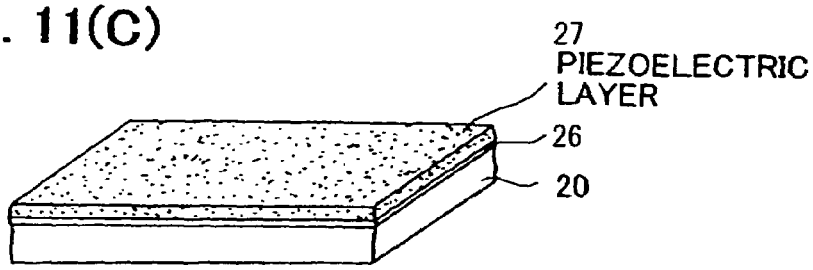

An individual electrode layer 26 (hereinafter referred to merely as the 'electrode layer') and a piezoelectric body layer 27 are formed in order on the substrate 20 using sputtering, which is a thin film formation technique. Specifically, firstly the electrode layer 42 is formed on the substrate 20 as shown in FIG. 11(B), and then the piezoelectric body layer 41 is formed on the electrode layer 42 as shown in FIG. 11(C). In the present example, platinum (Pt) is used as the material of the electrode layer 42.

Figure 11D:
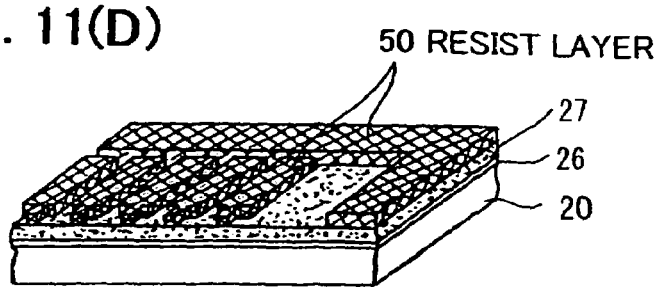

Next, a milling pattern for dividing the above laminate into portions in positions corresponding to the pressure chambers that will be formed later is formed from a dry film resist (hereinafter referred to as 'DF-1') 50. FIG. 11(D) shows the state after the DF-1 pattern 50 has been formed; the DF-1 pattern 50 is formed in places where the electrode layer 42 and the piezoelectric body layer 41 are to be left behind.

In the present example, FI-215 (made by Tokyo Ohka Kogyo Co., Ltd.; alkali type resist, thickness 15 μm) was used as the DF-1, and after laminating on at 2.5 kgf/cm, 1 m/s and 115° C., 120 mJ exposure was carried out with a glass mask, preliminary heating at 60° C. for 10 minutes and then cooling down to room temperature were carried out, and then developing was carried out with a 1 wt % $Na_2CO_3$ solution, thus forming the pattern.

Figure 11E:
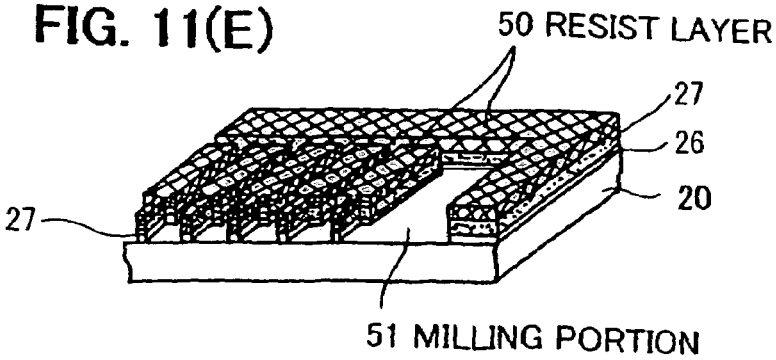

The substrate was fixed to a copper holder using grease (Apiezon L Grease) having good thermal conductivity, and milling was carried out at 700V using Ar gas only with an irradiation angle of 15°. As a result, the shape became as shown in FIG. 11(E), with the taper angle in the depth direction of the milled parts becoming perpendicular, i.e. at least 85°, relative to the surface.

Figure 12F:
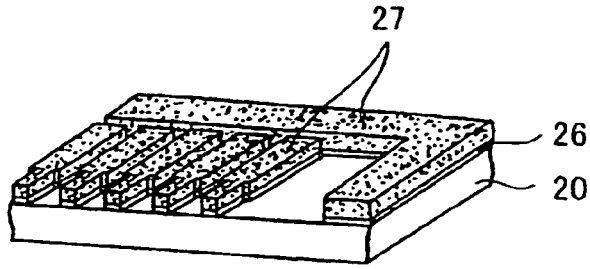
FIGS. 12 (F), 12 (G), 12 (H) and 12 (I) consist of (second) explanatory drawings of the manufacturing process of the head of FIG. 2.
Figure 12G:
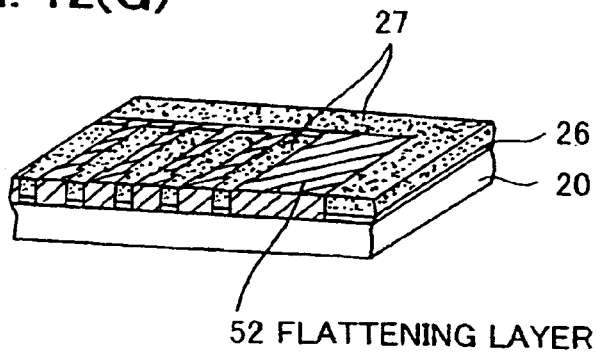

Next, the DF-1 50 is removed as shown in FIG. 12(F), and then, so that the diaphragm 23 can be made flat, and also to carry out insulation between the upper electrodes (electrode layer 26) and the diaphragm, which is the common electrode, at the milled parts, an insulating flattening layer 52 is formed in the milled parts (FIG. 12(G)).

Figure 12H:
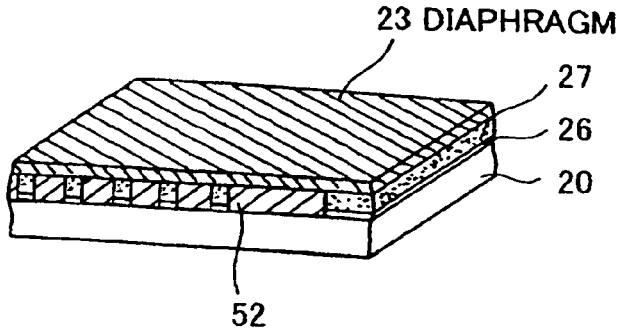

Next, as shown in FIG. 12(H), a laminated type diaphragm 23 is deposited by sputtering, thus forming the actuator parts. As the method of forming the diaphragm 23, in the present example, making the head have a nozzle pitch of 150 dpi (pressure chamber width 100 μm, length 700 μm; piezoelectric body width 70 μm, length 900 μm, 64 elements per row), Cr was formed to 0.3 μm over the whole surface as the electrode layer 23-1, and on top of this TiN (600 GPa) was formed to 0.2 μm as the rigid layer 23-2, thus constituting the diaphragm 23.

Figure 12I:
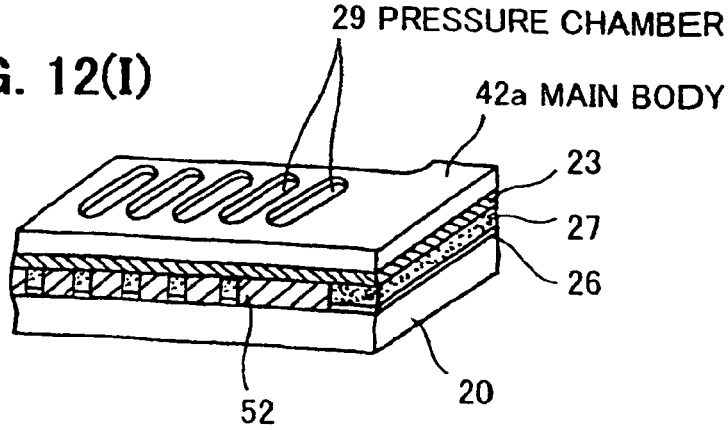

After the formation of the various layers 23 to 27 has been completed as described above using thin film formation techniques, next pressure chamber opening parts are formed in positions corresponding to the respective piezoelectric bodies of the layers 23 to 27 as shown in FIG. 12(I).

In the present example, the formation was carried out using a solvent type dry film resist (hereinafter referred to as 'DF-2') 42*a*. The DF-2 used was PR-100 series (made by Tokyo Ohka Kogyo Co., Ltd.); laminating on was carried out at 2.5 kgf/cm, 1 m/s and 35° C., and then using a glass mask, alignment was carried out using alignment marks (not shown) in the pattern for the piezoelectric bodies 27 (and the electrode layer 26) from the time of the milling described earlier and 180 mJ exposure was carried out, preliminary heating at 60° C. for 10 minutes and then cooling to room temperature were carried out, and then developing was carried out using C-3 and F-5 solutions (made by Tokyo Ohka Kogyo Co., Ltd.), thus forming a pressure chamber pattern 29.

Moreover, a main body part 42*b* having the pressure chambers 29 and a nozzle plate 38 are formed through a process separate to the process described above. The main body part 42*b* having the pressure chambers 29 is formed on the nozzle plate 38 (which has alignment marks, not shown) by laminating on a dry film (PR series solvent type dry film made by Tokyo Ohka Kogyo Co., Ltd.) and exposing a required number of times and then developing (nozzle plate disposing step).

The specific method of forming the main body part 42*b* is as follows. On the nozzle plate 38 (thickness 20 μm), a pattern of ink lead-through channels 41 (diameter 60 μm; depth 60 μm) for leading ink from the pressure chambers 29 to the nozzles 39 (diameter 20 μm, straight holes) and making the ink flow be in one direction is exposed using the alignment marks on the nozzle plate 38, and then the pressure chambers 29 (width 100 μm, length 1700 μm, thickness 60 μm) are exposed as for the ink lead-through channels 41 using the alignment marks on the nozzle plate 38, next the structure is left naturally (at room temperature) for 10 minutes and then curing is carried out by heating (60° C., 10 minutes), and then unwanted parts of the dry film are removed by solvent developing.

Figure 13J:
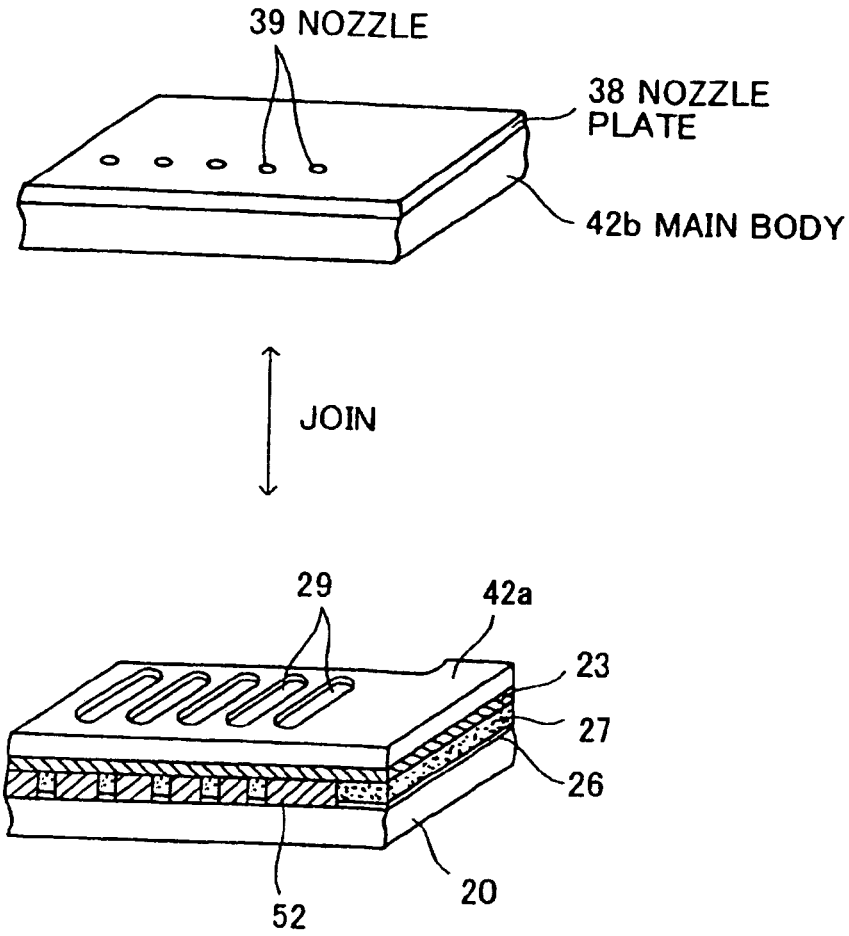
FIGS. 13 (J) and 13 (K) consist of (third) explanatory drawings of the manufacturing process of the head of FIG. 2.

The main body part 42*b* provided with the nozzle plate 38 formed as described above is joined (joined and fixed) to the other main body part 42*a* (FIG. 12(I)) having the actuator parts as shown in FIG. 13(J). At this time, the joining is carried out such that the main body parts 42*a* and 42*b* face one another accurately at the pressure chamber 29 parts. The joining is carried out using alignment marks on the piezoelectric body parts and alignment marks formed on the nozzle plate, by carrying out, at a load of 15 kgf/cm$^2$, preliminary heating at 80° C. for 1 hour followed by the main joining at 150° C. for 14 hours, and then allowing natural cooling to take place.

Next, the substrate of the driving parts is removed so that the actuators will be able to vibrate. The substrate 20 is turned upside down so that the nozzle plate 38 is on the underside, and an opening part 24 is formed by removing approximately the central part of the substrate 20 by etching (removal step).

Figure 13K:
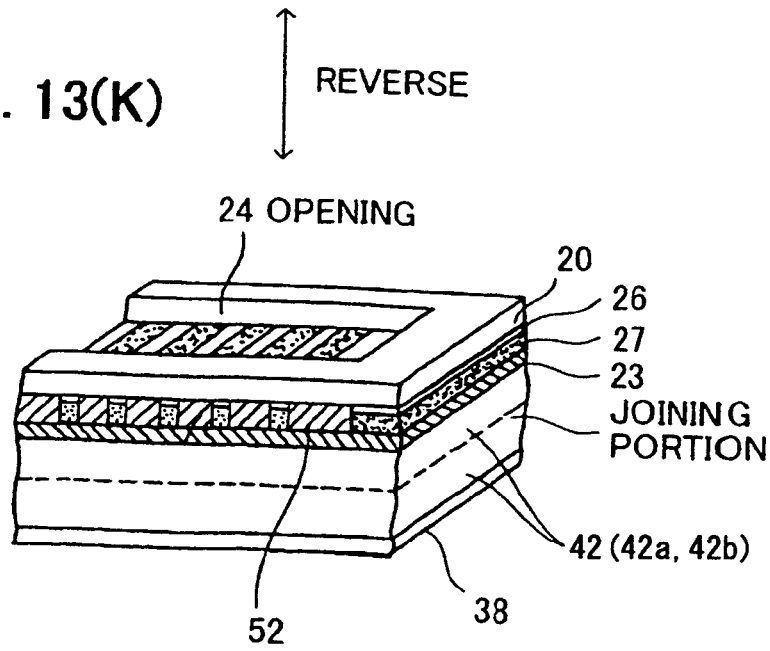

The position in which the opening part 24 is formed is selected so as to correspond to at least the deformation region in which the diaphragm 23 is deformed by the energy generating parts (see FIG. 2). By removing the substrate 20 and forming the opening part 24 in this way, the constitution becomes such that the electrode layer 26 is exposed from the substrate 20 via the opening part 24 as shown in FIG. 13(K).

As described above, according to the present example, the energy generating parts are formed on the substrate 20 by forming an electrode layer 26, a piezoelectric body layer 27 and a diaphragm 23 in order using a thin film formation technique such as sputtering; compared with conventionally, thin energy generating parts can thus be formed with higher precision (i.e. with the same shape as the upper electrodes) and wither high reliability.

Moreover, because a separate joining material such as an adhesive is not interposed between the respective layers 23 to 27, it becomes possible to form highly flat energy generating parts, and there is no problem of an adhesive absorbing the displacement of the piezoelectric bodies as conventionally.

An ink jet recording head 2 that enables power consumption to be reduced and printing resolution to be increased can thus be realized.

Moreover, the fences formed through the milling can be removed using the same milling apparatus merely by changing the angle, which is effective during mass production. By carrying out such flattening and moreover filling the milled parts with a flattening material, the diaphragm 23 can be made flat, the adhesion between the piezoelectric bodies 27 and the diaphragm 23 becomes good, and an ink jet recording head 2 for which efficient driving with no fluctuation can be carried out can be realized.

Figure 37:
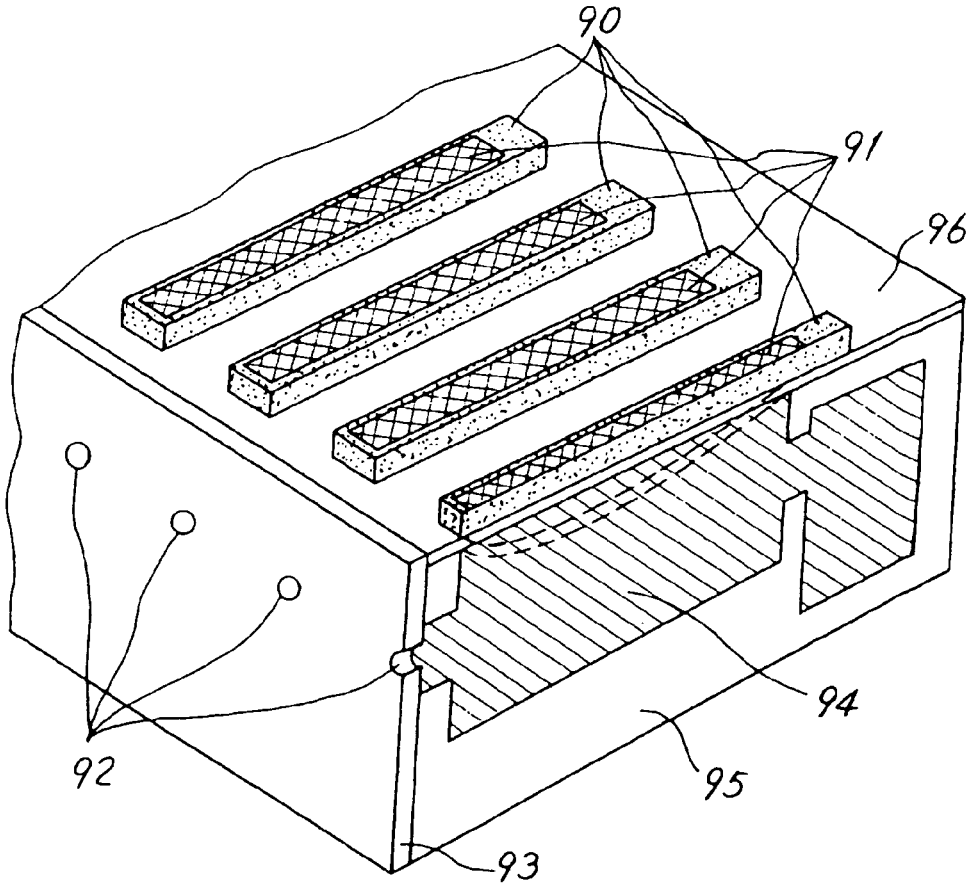
FIG. 37 PRIOR ART
FIG. 37 is a drawing of the constitution of a conventional multi-nozzle ink jet head.

Moreover, in the removal step described above, the energy generating parts are exposed from the substrate 20 by removing a prescribed region of the substrate 20 to form an opening part 24, and hence the energy generating parts can be protected better than with a conventional constitution (see FIG. 37) in which the piezoelectric bodies and so on are merely exposed. The energy generating parts are thus not damaged even if they are made thin, and hence the reliability of the ink jet recording head 2 can be improved.

Second Embodiment

Figures 14, 15:
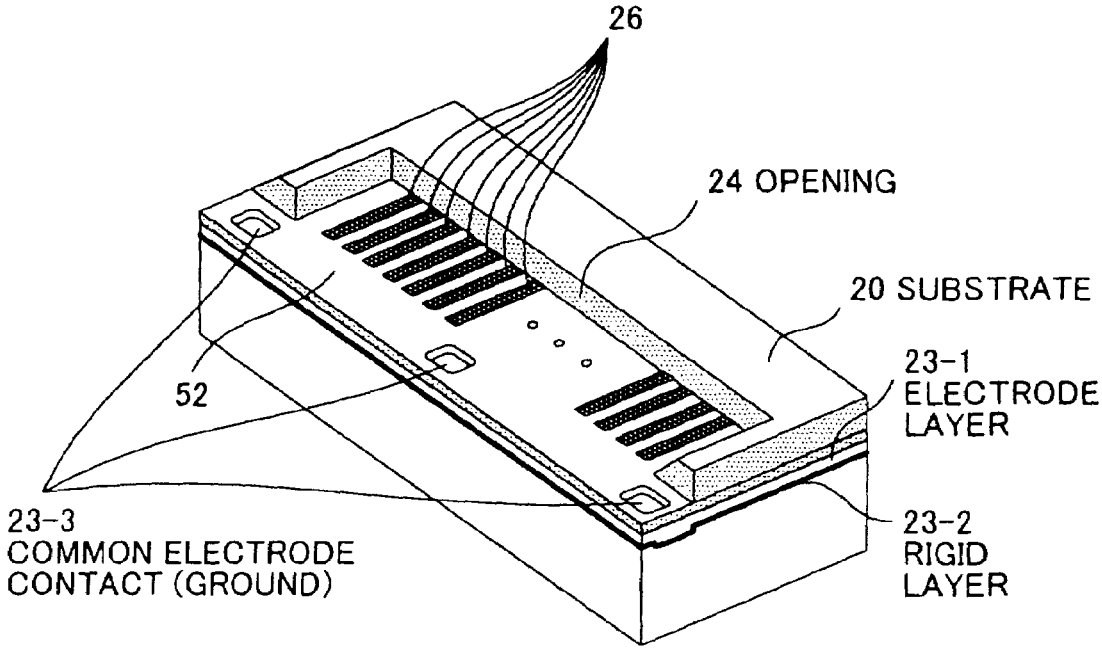
FIG. 14 is a sectioned perspective view of an ink jet head of a second embodiment of the present invention.
FIG. 15 is a table of rise characteristics for an example of the head of FIG. 14.

FIG. 14 is an external view of the multi-nozzle head of a second embodiment of the present invention. Elements the same as ones shown in FIG. 2 are represented by the same reference numerals. In contrast with the method shown in FIG. 2 in which an earth is led to the outside at both ends of the row of piezoelectric bodies from the electrode layer 23-1 at the front, in FIG. 14*a* constitution is adopted in which earths are lead out at several points (3 points or more). That is, 3 common electrode contact parts (grounds) 23-3 are provided.

As a result, the distance to the furthest pin from each ground as shown in FIG. 3 is shortened, and hence the resistance value is correspondingly lower. It is thus possible to use a yet thinner electrode layer. Next, examples of this embodiment of the present invention will be described.

EXAMPLE 3

Figures 16, 17:
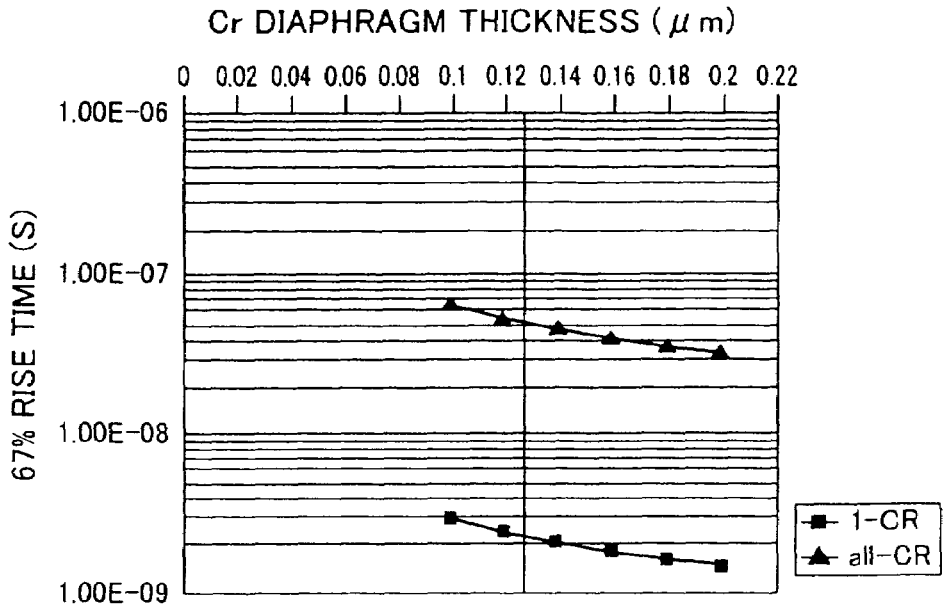
FIG. 16 is a graph showing the relationship between thickness and rise time for the head of the example of FIG. 15.
FIG. 17 is a table of rise characteristics for another example of the head of FIG. 14.

FIG. 15 shows calculation results of the resistance value, the rise time 1-CR during 1-pin driving, and the waveform rise time all-CR during all-pin driving for various thickness of the electrode layer for the case that, in a 150 dpi multi-nozzle head of the size shown in FIG. 6, Cr (resistivity 1.27 μΩ·m) was used as the common electrode layer 23-1 and the number of nozzles was 64 pins; FIG. 16 is a graph of these results.

The results are that, because earthing is carried out at 3 points, the number of elements served by each contact from the outside is lower than in the case of FIG. 7, and hence the required metal thickness can be made yet thinner. In the present study, a structure that is very thin at 0.13 μm can be selected, compared with 0.3 μm with 2 contacts.

EXAMPLE 4

Figure 18:
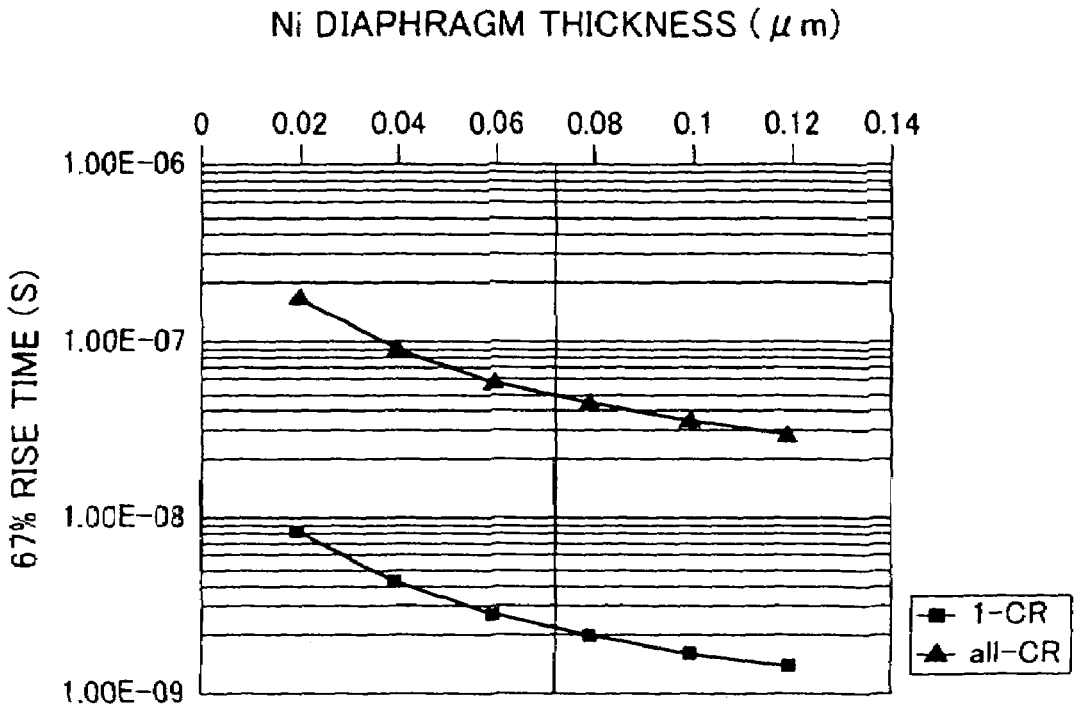
FIG. 18 is a graph showing the relationship between thickness and rise time for the head of the other example of FIG. 17.

In a 150-dpi head of the constitution of FIG. 14, Ni (resistivity 0.724 μΩ·m) was used as the electrode layer 23-1. FIG. 17 shows calculation results of the resistance value, the waveform rise time 1-CR during 1-pin driving, and the waveform rise time all-CR during all-pin driving for thicknesses of the Ni from 0.02 to 0.12, and FIG. 18 is a graph of these results.

The results are that, with the structure in which leading out is carried out at several points (3 points), the number of elements served by each contact from the outside is reduced, and hence the required metal thickness can be made yet thinner. In the present study, a structure that is very thin at 0.07 μm can be selected, compared with 0.18 μm for an Ni metal layer with 2 contacts.

Third Embodiment

Figure 19:
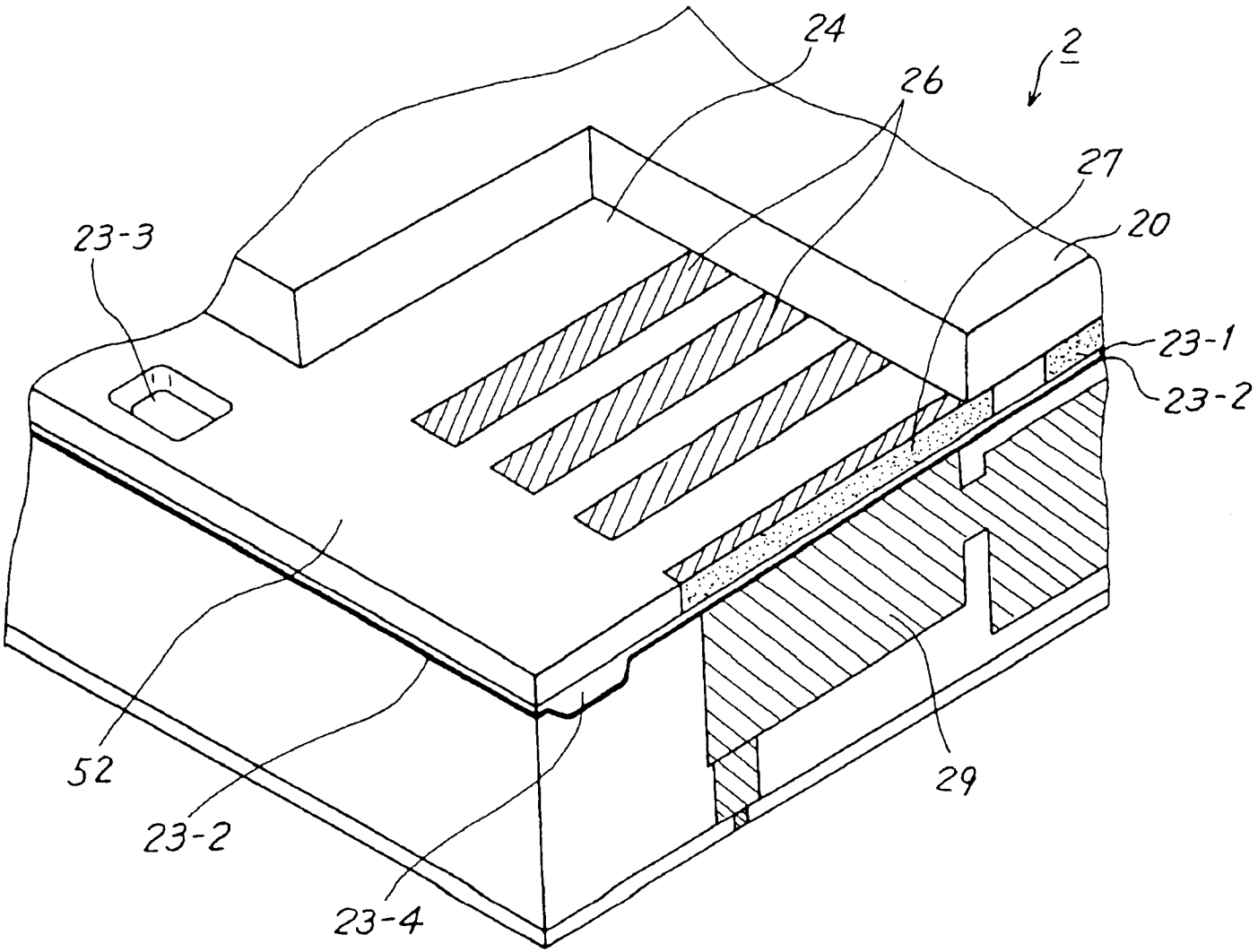
FIG. 19 is a sectioned perspective view of an ink jet head of a third embodiment of the present invention.

FIG. 19 is a perspective view of the multi-nozzle head of a third embodiment of the present invention, and FIG. 20 consists of drawings for explaining this head. In FIG. 19, elements the same as ones shown in FIG. 2 are represented by the same reference numerals. In this embodiment, a ground line (low-resistance layer) 23-4 is formed in a position parallel to the row of piezoelectric bodies 27 in the first embodiment.

As shown in FIG. 20, the distances (resistance values) rG1 to rGn between the ground line 23-4, which is connected to the ground contact 23-3, and each of the piezoelectric elements 27 are equal. That is, by providing the low-resistance ground line 23-4, as shown in FIG. 20, the equivalent circuit for during multi-pin driving becomes integration circuits that are in parallel relative to the ground line 23-4. The resistance value for each of the pins simply has the resistances rg1 to rgn of the ground line 23-4 added thereto.

The driving lag for each pin during all-pin driving can thus be further reduced, or from an opposite standpoint the electrode layer 23-1 can be made yet thinner. Following is a description of the constitution of the ground line 23-4 and a method of manufacturing the head of FIG. 21.

FIG. 21 shows only the diaphragm formation step of FIG. 12(H); the other steps are as in FIGS. 11 to 13. As shown in FIG. 21(L), after forming the Cr electrode layer 23-1 to a thickness of 0.1 m, a ground line formation step was carried out. The electrode material used was Cr, and the gap between the row of piezoelectric bodies and the ground line 23-4 was made to be 200 μm.

Figure 21L:
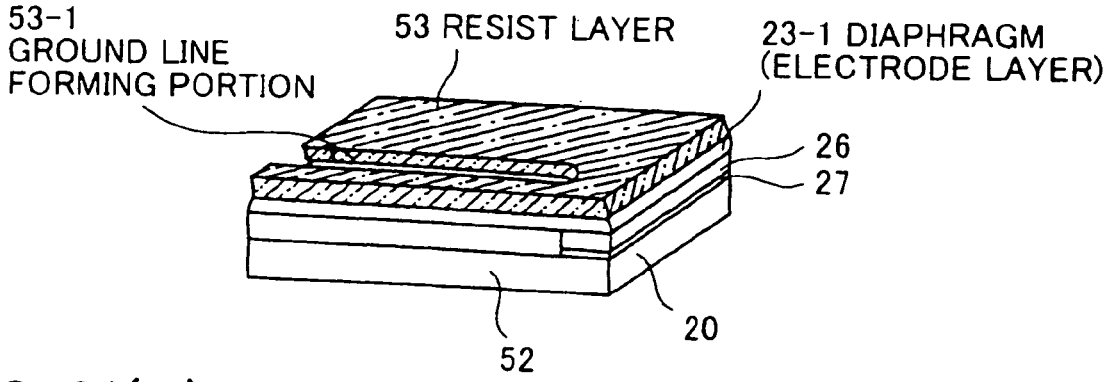
FIGS. 21 (L), 21 (M), 21 (N) and 21 (O) consist of explanatory drawings of a manufacturing process of the head of FIG. 19.
Figure 21M:
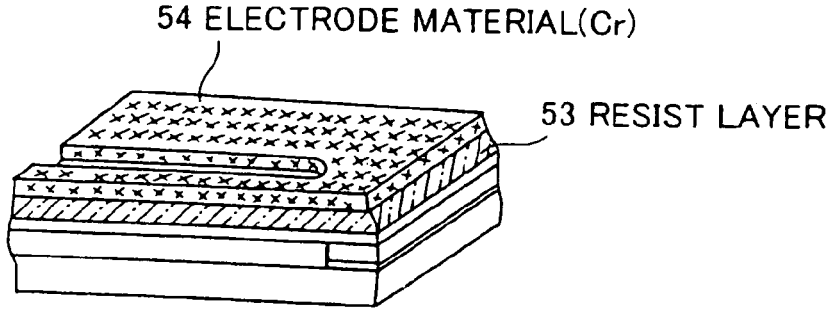
Figure 21N:
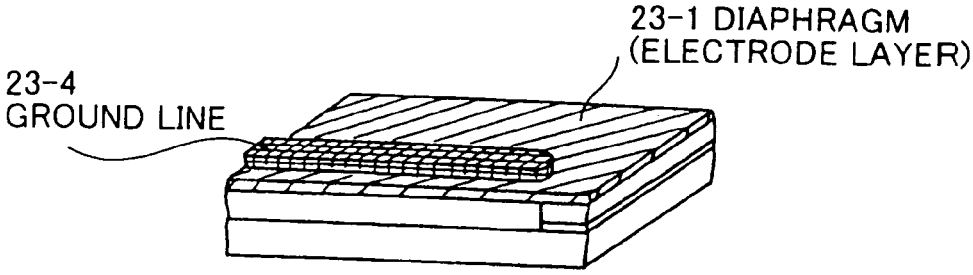
Figure 21O:
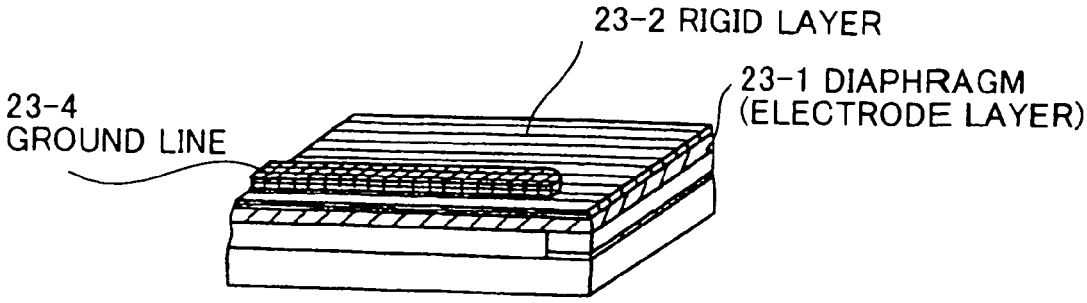

In the step, as shown in FIG. 21(L), a DF (resist layer) 53 is laminated onto the Cr electrode layer 23-1, alignment and exposure are carried out using a mask having a pattern such that a ground line forming part 53-1 becomes open, and then development is carried out. Then, as shown in FIG. 21(M), 1.6 μm of an electrode material (Cr) 54 is laminated on by sputtering as with the formation of the electrode layer (Cr) 23-1. Then, the resist layer 53 is dissolved, whereby only the ground line 23-4 remains of the electrode material 54 as shown in FIG. 21(N). Then, as shown in FIG. 21(O), 0.5 μm of TiN is formed as the rigid layer 23-2 of the diaphragm.

Compared with the first embodiment, the electrode layer 23-1 can be made thinner; the thickness of the rigid layer 23-2 is thus more than doubled, and hence the rigidity of the laminated diaphragm as a whole rises, and moreover the diaphragm as a whole becomes thinner and bends more easily.

In the subsequent resin pressure chamber formation step of FIG. 12(I), the stepped part of the ground line 23-4 can easily be taken up by the resin layer 42*a*, and hence the joining surface for the next step can be made flat, and thus no problems arise. Moreover, because the ground line 23-4 is provided in a region other than where the pressure chambers 29 are, even if the ground line 23-4 is made think, there will be no influence on the performance of the diaphragm. It is thus possible to form a ground line having a low resistance value using a thick metal layer.

With this structure, yet better characteristics can be obtained than with the method shown in FIG. 14 in which leading out is carried out at several points (3 points in the table); the structure used is an earth line (ground line) 23-4 that is electrically connected to the electrode layer 23-1 in a position parallel to the row of piezoelectric bodies, and hence leading out of earths to the outside is carried out at both ends of the row of piezoelectric bodies.

Next, examples of the above embodiment of the present invention will be described.

EXAMPLE 5

Figures 22, 23:
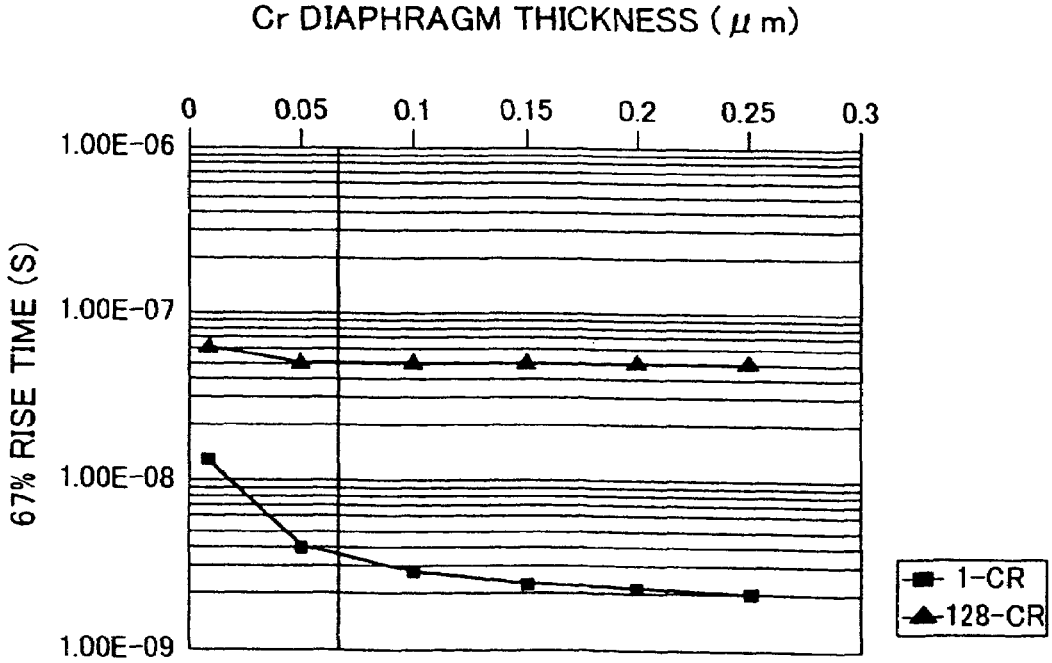
FIG. 22 is a table of rise characteristics for an example of the head of FIG. 19.
FIG. 23 is a graph showing the relationship between thickness and rise time for the head of the example of FIG. 19.

FIG. 22 shows calculation results of the resistance value, the rise time 1-CR during 1-pin driving, and the waveform rise time all-CR during all-pin driving for various thickness of the electrode layer for the case that, in a 150 dpi multi-nozzle head of the size shown in FIG. 6, Cr (resistivity 1.27 μΩ·m) was used as the common electrode layer 23-1 and the number of nozzles was 128 pins. FIG. 23 is a graph of these results.

The results are that, in the case that the ground line (width 600 μm, thickness 1.6 μm) is positioned parallel to and 200 μm away from the row of piezoelectric bodies, it can be seen that it is sufficient for the metal layer 23-1 on the pressure chambers to be about 0.06 μm, and hence a much thinner structure can be selected than the structures described earlier.

EXAMPLE 6

In a 150-dpi head of the constitution of FIG. 22, Ni (resistivity 0.724 μΩ·m) was used as the electrode layer 23-1. FIG. 24 shows calculation results of the resistance value, the waveform rise time 1-CR during 1-pin driving, and the waveform rise time all-CR during all-pin driving for thicknesses of the Ni from 0.002 to 0.2, and FIG. 25 is a graph of these results.

In the case that Ni is used and the ground line (width 600 μm, thickness 1.0 μm) 23-4 is positioned parallel to and 200 μm away from the row of piezoelectric bodies, according to the present results it can be seen that it is sufficient for the metal layer 23-1 on the pressure chambers to be about 0.01 μm, and hence a much thinner structure can be selected than the structures described earlier.

EXAMPLE 7

Figure 27:
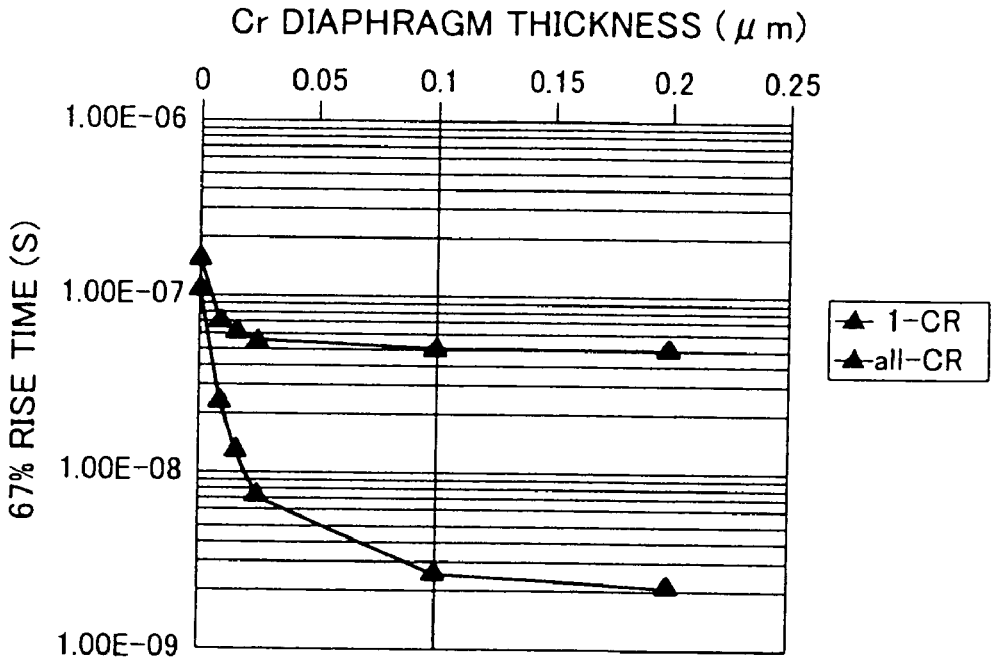
FIG. 27 is a graph showing the relationship between thickness and rise time for the head of the yet other example of FIG. 19.

As shown in FIG. 26, this is an example of a high-density head for which, in the case of the constitution of FIG. 19, the nozzle pitch is 300 dpi; the pressure chamber width was made to be 50 μm, and the piezoelectric body width 45 μm. For a study of the case that Cr is used as the metal, FIG. 27 shows calculation results of the resistance value, the waveform rise time 1-CR during 1-pin driving, and the waveform rise time all-CR during all-pin driving for thicknesses of the Cr from 0.001 to 0.2, along with a graph of these results.

From the results, if the thickness of the metal layer 23-1 on the pressure chambers is made to be about 0.1 m, then there will be no problems in terms of electrical characteristics if the width of the ground line is 200 μm and the thickness 1.1 μm.

Fourth Embodiment

FIG. 28 is an external view of the head of a fourth embodiment of the present invention; elements the same as ones shown in FIG. 14 and FIG. 19 are represented by the same reference numerals.

As shown in FIG. 28, the head of the present embodiment is a head for which, in the case of the structure of the ground line 23-4 shown in FIG. 19, the earth contacts 23-3 led to the outside as shown in FIG. 14 are made to be at several points. As a result, the ground line 23-4 can be made yet narrower (space can be saved) and thinner (allowing mass production). Next, examples of this embodiment of the present invention will be described.

EXAMPLE 8

FIG. 29 shows calculation results of the resistance value, the rise time 1-CR during 1-pin driving, and the waveform rise time all-CR during all-pin driving for various thickness of the electrode layer for the case that, in a 150 dpi multi-nozzle head of the size shown in FIG. 6 and the structure shown in FIG. 28, Cr (resistivity 1.27 μΩ·m) was used as the common electrode layer 23-1 and the ground line, and the number of nozzles was 128 pins; FIG. 30 is a graph of these results.

The results are that, in the case that the ground line (width 600 μm, thickness 1.0 μm) 23-4 is positioned parallel to and 200 μm away from the row of piezoelectric bodies, it can be seen that it is sufficient for the metal layer 23-1 on the pressure chambers to be about 0.003 μm, and hence a much thinner structure can be selected than the structures described earlier. However, 0.003 μm is of the order of angstroms, and hence is not practicable. In actual practice, considering the uniformity and so on of the metal film, the minimum thickness is about 0.1 μm, and taking this as a lower limit, there will be no problems in terms of electrical characteristics if the width of the ground line is 210 μm and the thickness 0.5 μm.

EXAMPLE 9

Figures 32, 33:
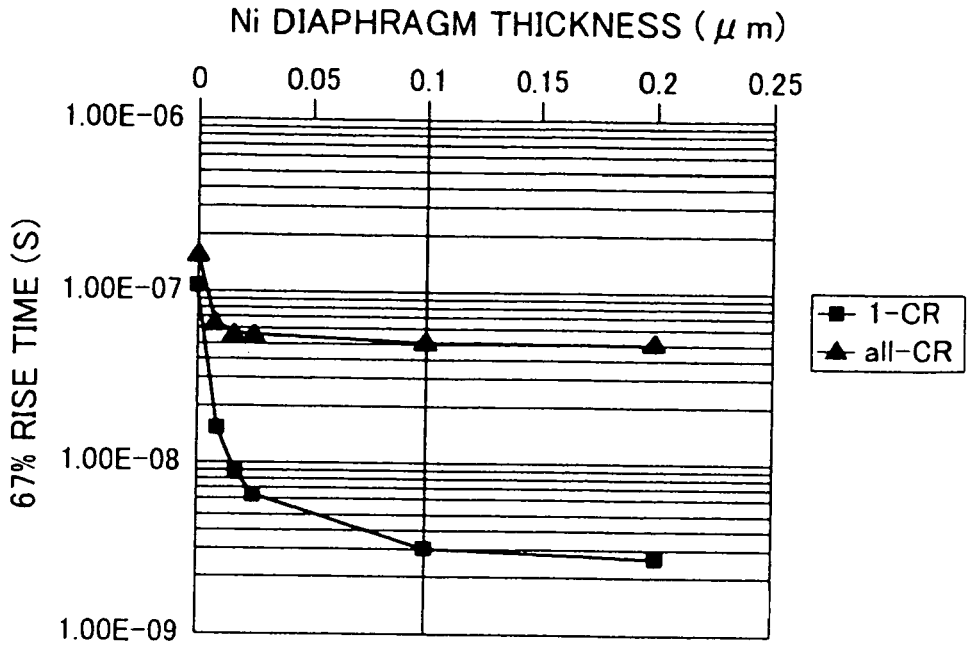
FIG. 32 is a graph showing the relationship between thickness and rise time for the head of the other example of FIG. 31.
FIG. 33 is a table showing the relationship between thickness and rise time for the head of yet another other example of FIG. 31.

FIG. 31 shows calculation results of the resistance value, the rise time 1-CR during 1-pin driving, and the waveform rise time all-CR during all-pin driving for various thicknesses of the electrode layer for the case that, with the structure shown in FIG. 29, Ni was used as the common electrode layer 23-1 and the ground line, and the number of nozzles was 128 pins; FIG. 32 is a graph of these results.

In the case that the ground line (width 600 μm, thickness 1.0 μm) 23-4 is positioned parallel to and 200 μm away from the row of piezoelectric bodies, according to the present results, it can be seen that it is sufficient for the metal layer on the pressure chambers to be about 0.002 μm, and hence a much thinner structure can be selected than the structures described earlier.

However, this case is also not practicable, and hence if the minimum thickness is made to be about 0.1 m, then there will be no problems in terms of electrical characteristics if the width of the ground line is 120 μm and the thickness 0.5 μm.

EXAMPLE 10

Figure 34:
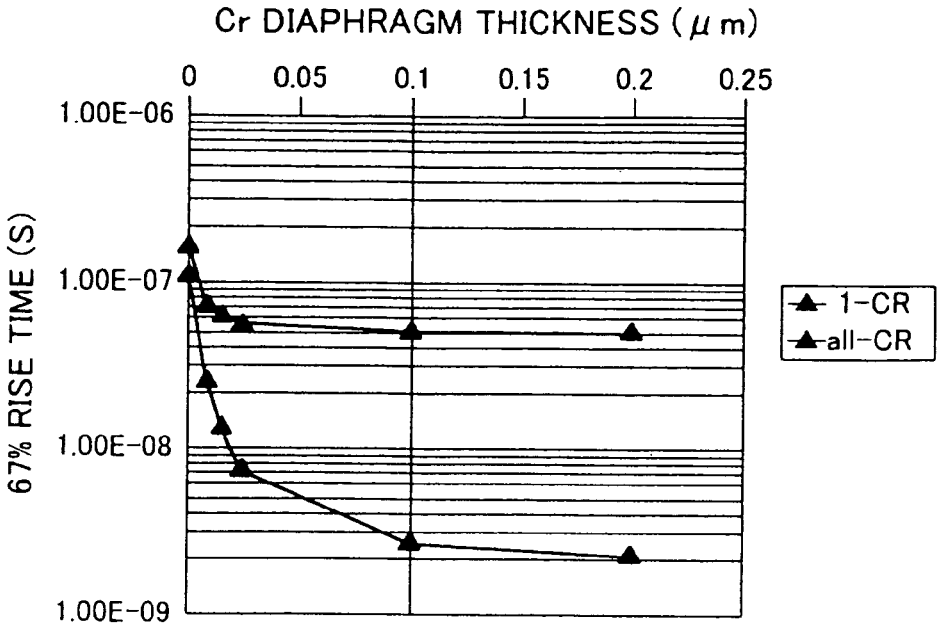
FIG. 34 is a graph of rise characteristics for the diaphragm of the head of FIG. 28.

FIG. 33 shows an example of application to a 300 dpi head with the structure shown in FIG. 29. FIG. 33 shows calculation results of the resistance value, the rise time 1-CR during 1-pin driving, and the waveform rise time all-CR during all-pin driving for various thickness of the electrode layer, for the case that Cr was used as the common electrode layer 23-1 and the ground line, and the number of nozzles was 128 pins; FIG. 34 is a graph of these results.

From these results, if the thickness of the metal layer 23-1 on the pressure chambers is made to be about 0.1 μm, then there will be no problems in terms of electrical characteristics if the width of the ground line is 100 μm and the thickness 1.0 μm.

Figure 35:
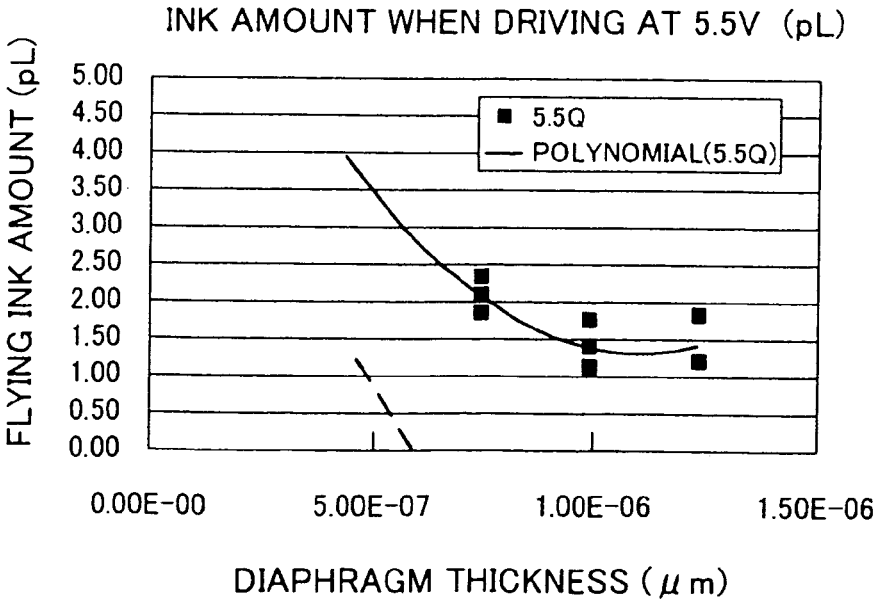
FIG. 35 is a graph of ink flight amount characteristics for the diaphragm of the head of FIG. 28.

Next, a description will be given of the optimal selection of the rigid layer 23-2 for the thin electrode layer 23-1. FIGS. 35 and, 36 are graphs showing the relationship between the ink flight amount and the Helmholtz frequency respectively and the thickness of the rigid layer (TiN; Young's modulus 600 GPa) for the case that the Cr electrode layer 23-1 was made to be 0.1 μm.

Figure 36:
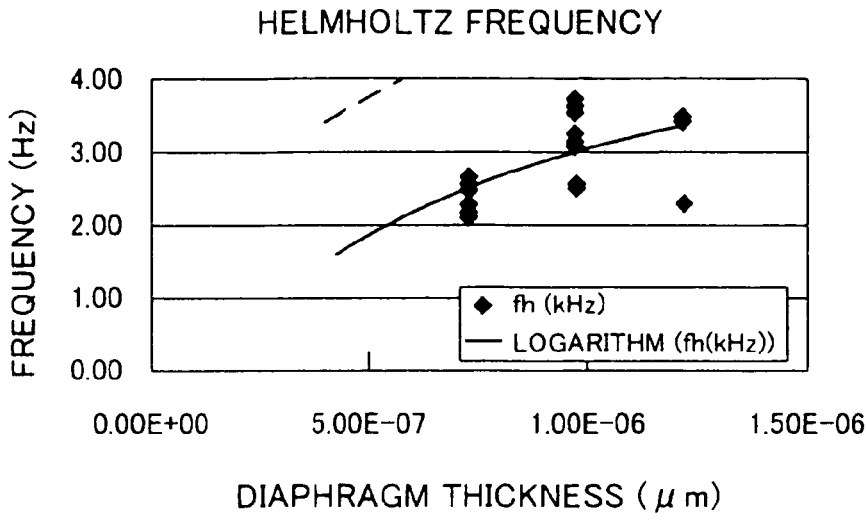
FIG. 36 is a graph showing the Helmholtz frequency for FIG. 35.

As shown in FIGS. 35 and 36, if the rigid layer 23-2 is made thick, then the diaphragm becomes stiff, the springiness increases, and the frequency during driving increases. However, because the diaphragm becomes stiff, the diaphragm bends with difficulty during constant voltage driving (5.5V), and hence the amount of deformation drops. That is, the volume change in the pressure chamber drops, and hence the ink flight amount drops as shown in FIG. 35.

The thickness of the rigid layer can thus be selected in accordance with the required ink flight amount and driving frequency. Moreover, the dashed lines on the graphs show the characteristics for the case that the Cr electrode layer was made to be 1 μm; it can be seen that because the diaphragm is stiff, ink flight becomes difficult.

The present invention was described above through embodiments; however, various modifications are possible within the scope of the purport of the present invention, and these are not excluded from the scope of the present invention.

INDUSTRIAL APPLICABILITY

By making the metal layer that acts as an electrode in the multi-layer diaphragm be as thin as possible but such that there are no electrical problems, the scope of selection for formation of the rigid layer can be broadened. By forming a low-resistance part (ground line) in a position parallel to the row of piezoelectric bodies, the metal layer can be made yet thinner.

By making leading out to the outside from the ground line be at several points, the ground line can be made finer. Through the constitution of the ground line, the electrical loss in the case of single-pin flight and the case of multi-pin flight can be reduced, and the printing quality can be improved.

The invention claimed is:

1. A multi-nozzle ink jet head which is manufactured by a thin film formation technique and has a plurality of nozzles, the multi-nozzle ink jet head comprising:

a head substrate in which the plurality of nozzles and a plurality of pressure chambers are formed;

a diaphragm that comprises a common electrode layer and a rigid layer and covers each of the plurality of pressure chambers;

a plurality of piezoelectric elements provided on the diaphragm in correspondence with the pressure chambers; and a plurality of individual electrodes provided on the piezoelectric elements in correspondence with the piezoelectric elements, wherein the common electrode layer has a thickness so as to have a resistance value such that a lag in a rise time of a driving waveform when driving all of the piezoelectric elements relative to a rise time of a driving waveform when driving a single one of the piezoelectric elements, is not greater than 50 ns.

2. A multi-nozzle ink jet head which is manufactured by a thin film formation technique and has a plurality of nozzles, the multi-nozzle ink jet head comprising:

a head substrate in which the plurality of nozzles and a plurality of pressure chambers are formed;

a diaphragm that comprises a common electrode layer and a rigid layer and covers each of the plurality of pressure chambers;

a plurality of piezoelectric elements provided on the diaphragm in correspondence with the pressure chambers; and a plurality of individual electrodes provided on the piezoelectric elements in correspondence with the piezoelectric elements, wherein the common electrode layer has a minimum thickness of thicknesses of the common electrode layer selected from a range such that a lag in a rise time of a driving waveform when driving all of the piezoelectric elements relative to a rise time of a driving waveform when driving a single one of the piezoelectric elements results in a positional shift of not more than half a dot of a recorded dot formed by a minimum ink amount flying.

* * * * *